US012270136B2

(12) United States Patent
Mori

(10) Patent No.: US 12,270,136 B2
(45) Date of Patent: Apr. 8, 2025

(54) PRESSING DEVICE SUPPORTING PRESSER FOOT AND SEWING MACHINE PROVIDED WITH THE PRESSING DEVICE

(71) Applicant: BROTHER KOGYO KABUSHIKI KAISHA, Nagoya (JP)

(72) Inventor: Hiroki Mori, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/343,387

(22) Filed: Jun. 28, 2023

(65) Prior Publication Data

US 2023/0416959 A1 Dec. 28, 2023

(30) Foreign Application Priority Data

Jun. 28, 2022 (JP) ..... 2022-103570

(51) Int. Cl.
*D05B 29/06* (2006.01)
*D05B 55/06* (2006.01)

(52) U.S. Cl.
CPC ..... *D05B 29/06* (2013.01); *D05B 55/06* (2013.01)

(58) Field of Classification Search
CPC ..... D05B 29/06; D05B 29/08; D05B 29/10; D05B 29/12; D05B 29/00; D05B 29/02
See application file for complete search history.

(56) References Cited

U.S. PATENT DOCUMENTS 2,742,009 A * 4/1956 Enos ..... D05B 27/04 112/235
3,044,428 A * 7/1962 Hale ..... D05B 29/02 112/235
3,495,560 A * 2/1970 Walling ..... D05B 29/00 112/235
3,623,441 A * 11/1971 Schoij ..... D05B 29/00 112/235

(Continued)

FOREIGN PATENT DOCUMENTS

CN 109183288 A * 1/2019 ..... D05B 29/06
JP S56-035379 U 4/1981

(Continued)

OTHER PUBLICATIONS

Nov. 30, 2023 Extended Search Report issued in European Patent Application No. 23181874.1.

*Primary Examiner* — Danny Worrell
(74) *Attorney, Agent, or Firm* — Oliff PLC

(57) ABSTRACT

In a pressing device, a first member is movable in an up-down direction along with a presser bar of a sewing machine in a mounted state in which the pressing device is mounted on the presser bar. A second member supports a presser foot. The presser bar applies, through the second member, a presser force to the presser foot downward in the mounted state. A third member is disposed between the first and second members in the up-down direction in the mounted state. A gap-adjusting member adjusts a gap between the first and third members by contacting at least one of the first and third members. An urging member urges the second and third members away from each other with an urging force smaller than the pressing force of the presser bar. A guide part guides movement of the second and third members relative to the first member.

17 Claims, 13 Drawing Sheets

(56) References Cited

U.S. PATENT DOCUMENTS

| | | | | | |
|---|---|---|---|---|---|
| 3,796,173 | A * | 3/1974 | Godsen | D05B 29/00 | 112/235 |
| 4,058,071 | A * | 11/1977 | Dunn | D05B 29/02 | 112/235 |
| 4,166,423 | A * | 9/1979 | Brienza | D05B 47/04 | 112/254 |
| 4,869,188 | A * | 9/1989 | Hyodo | D05B 19/105 | 112/458 |
| 7,918,387 | B2 * | 4/2011 | Kahn | G06K 19/06046 | 235/375 |
| 7,983,782 | B2 * | 7/2011 | Nomura | B65H 49/04 | 700/136 |
| 9,435,062 | B2 * | 9/2016 | Kongo | D05B 19/04 | |
| 9,464,372 | B2 * | 10/2016 | Ueda | B26F 1/02 | |
| 2004/0000264 | A1 * | 1/2004 | Sakakibara | D05B 43/00 | 112/453 |
| 2005/0188906 | A1 * | 9/2005 | Goto | D05B 19/12 | 112/102.5 |
| 2009/0056607 | A1 * | 3/2009 | Fujita | D05B 29/08 | 112/237 |
| 2010/0017011 | A1 * | 1/2010 | Goldman | D05B 19/08 | 700/138 |
| 2010/0313803 | A1 * | 12/2010 | Okuyama | D05B 19/12 | 112/102.5 |
| 2011/0048300 | A1 * | 3/2011 | Tokura | D05C 5/06 | 112/102.5 |
| 2011/0048304 | A1 * | 3/2011 | Kato | D05B 91/16 | 206/389 |
| 2015/0345057 | A1 * | 12/2015 | Kongo | D05B 43/00 | 700/137 |
| 2018/0016720 | A1 * | 1/2018 | Okuyama | D05B 19/12 | |
| 2019/0309459 | A1 * | 10/2019 | Zheng | D05B 29/02 | |
| 2023/0313429 | A1 * | 10/2023 | Mori | D05B 29/12 | 112/240 |
| 2023/0416959 | A1 * | 12/2023 | Mori | D05B 55/06 | |
| 2023/0416960 | A1 * | 12/2023 | Mori | D05B 29/02 | |

FOREIGN PATENT DOCUMENTS

| | | | | |
|---|---|---|---|---|
| JP | H05-115641 | A | 5/1993 | |
| JP | H09-239170 | A | 9/1997 | |
| JP | H11-019358 | A | 1/1999 | |
| JP | 2001-187288 | A | 7/2001 | |
| JP | 3198818 | U | 7/2015 | |
| JP | 2019-130121 | A | 8/2019 | |
| JP | 2019-162284 | A | 9/2019 | |
| JP | 7117937 | B2 * | 8/2022 | D05B 27/06 |
| KR | 10-2022-0046857 | A | 4/2022 | |

* cited by examiner

PRESSING DEVICE SUPPORTING PRESSER FOOT AND SEWING MACHINE PROVIDED WITH THE PRESSING DEVICE

REFERENCE TO RELATED APPLICATIONS

This application claims priority from Japanese Patent Application No. 2022-103570 filed on Jun. 28, 2022. The entire content of the priority application is incorporated herein by reference.

BACKGROUND ART

A pressing device in a conventional sewing machine includes connecting members, a moving member, and an elastic member. The connecting members are connected to and pivotally move relative to a spindle of the sewing machine. The moving member moves in the up-down direction as the connecting members pivotally move. The elastic member is disposed between the moving member and a presser bar that applies an elastic force to the presser bar. The elastic force applied by the elastic member is changed by movement of the moving member. The pressing device changes the urging force applied to a presser foot provided on the lower end of the presser bar in association with the spindle of the sewing machine by moving the moving member so that the urging force of the elastic member is greater when the feed dog is raised above the throat plate than when the feed dog is positioned below the throat plate.

DESCRIPTION

However, the pressing device in the conventional sewing machine described above requires a complex configuration for changing the pressing force applied by the presser foot to the workpiece.

In view of the foregoing, it is an object of the present invention to provide a pressing device and a sewing machine having a simpler configuration for changing the pressing force that the presser foot applies to a workpiece.

In order to attain the above and other object, according to one aspect, the present disclosure provides a pressing device. The pressing device is to be mounted in a sewing machine. The sewing machine includes: a bed section; and a presser bar. A workpiece is to be placed on the bed section. The pressing device is to be mounted on the presser bar. The presser bar extends in an up-down direction and is configured to be urged downward. The pressing device includes: a first member; a second member; a third member; a gap-adjusting member; an urging member; and a guide part. The first member has a mounting part. The mounting part is configured to be mounted on the presser bar. The first member is movable in the up-down direction along with the presser bar in a mounted state in which the pressing device is mounted on the presser bar. The second member is configured to support a presser foot. The presser foot is configured to press the workpiece placed on the bed section downward. The presser bar is configured to apply, through the second member, a pressing force to the presser foot downward in the mounted state. The third member is disposed between the first member and the second member in the up-down direction in the mounted state. The third member is movable in the up-down direction in the mounted state. The gap-adjusting member is configured to adjust a gap between the first member and the third member by contacting at least one of the first member and the third member. The urging member is configured to urge the second member and the third member way from each other with an urging force smaller than the pressing force of the presser bar. The guide part is configured to guide movement of the second member and the third member relative to the first member.

With the configuration according to the aspect described above, the pressing device can change the pressing force that the presser foot applies to the workpiece through a simpler configuration than that of the conventional technology, i.e., without requiring the sewing machine to have a complex structure such as a link mechanism or other connecting members. In addition, by providing the pressing device with the gap-adjusting member, the gap between the first member and the third member can be easily changed after the pressing device has been mounted on the presser bar of the sewing machine.

According to another aspect, the present disclosure also provides a sewing machine. The sewing machine includes: a sewing machine motor; a needle bar; a throat plate; a feed dog; a feed mechanism; a presser bar; and a pressing device. The needle bar extends in an up-down direction and has a lower end portion on which a needle is to be mounted. The needle bar is configured to be urged downward. The needle bar is configured to be driven by the sewing machine motor to move in the up-down direction. The throat plate is formed with a needle hole and an opening. The needle is configured to pass through the needle hole in accordance with movement of the needle bar in the up-down direction. The feed dog is configured to emerge from and be retracted beneath the opening. The feed dog is configured to feed a workpiece placed on the throat plate. The feed mechanism is configured to be driven by the sewing machine motor to drive the feed dog. The presser bar extends in the up-down direction and has a lower end portion. The presser bar is configured to move in the up-down direction in synchronization with movement of the feed dog. The presser bar is configured to be urged downward. The pressing device is detachably mounted on the lower end portion of the presser bar. The pressing device includes: a first member; a second member; a third member; a gap-adjusting member; an urging member; and a guide part. The first member has a mounting part. The mounting part is configured to be mounted on the presser bar. The first member is movable in the up-down direction along with the presser bar in a mounted state in which the first member is mounted on the presser bar. The second member is configured to support a presser foot. The presser foot is configured to press the workpiece placed on the throat plate downward. The presser bar is configured to apply, through the second member, a pressing force to the presser foot downward. The third member is disposed between the first member and the second member in the up-down direction. The third member is movable in the up-down direction. The gap-adjusting member is configured to adjust a gap between the first member and the third member by contacting at least one of the first member and the third member. The urging member is configured to urge the second member and the third member away from each other with an urging force smaller than the pressing force of the presser bar. The guide part is configured to guide movement of the second member and the third member relative to the first member.

With the configuration according to the aspect described above, the sewing machine achieves the same effects as the pressing device of the one aspect.

Figure 8:
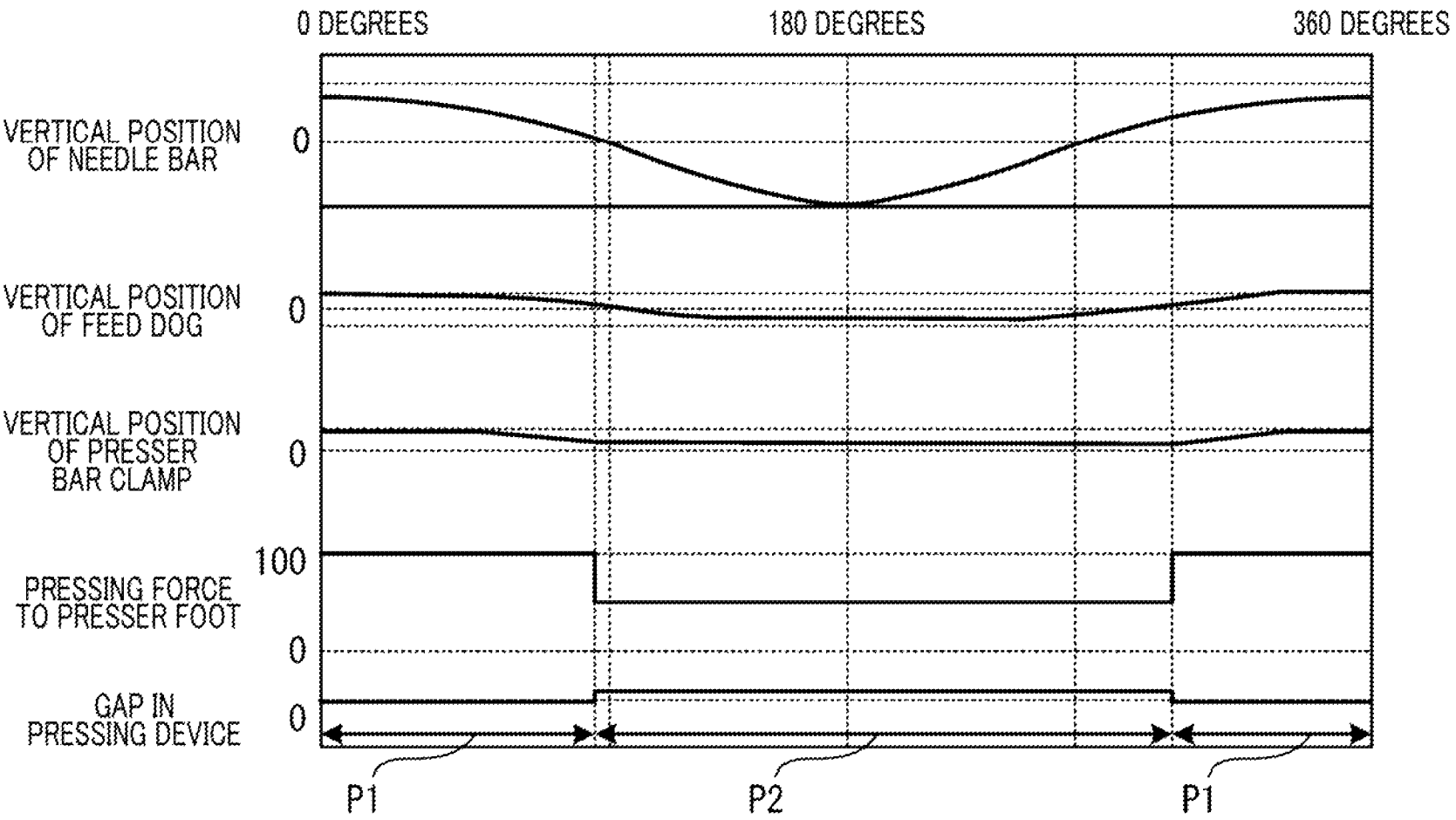

FIG. 8 is an explanatory diagram illustrating a position of a needle bar in an up-down direction, a position of the feeding dog in the up-down direction, a position of a presser bar clamp in the up-down direction, a pressure force applied to a workpiece from the presser foot, and a gap between a second member and the third member in the up-down direction as the rotational angle of a sewing machine motor changes in the sewing machine.

Figure 9A:
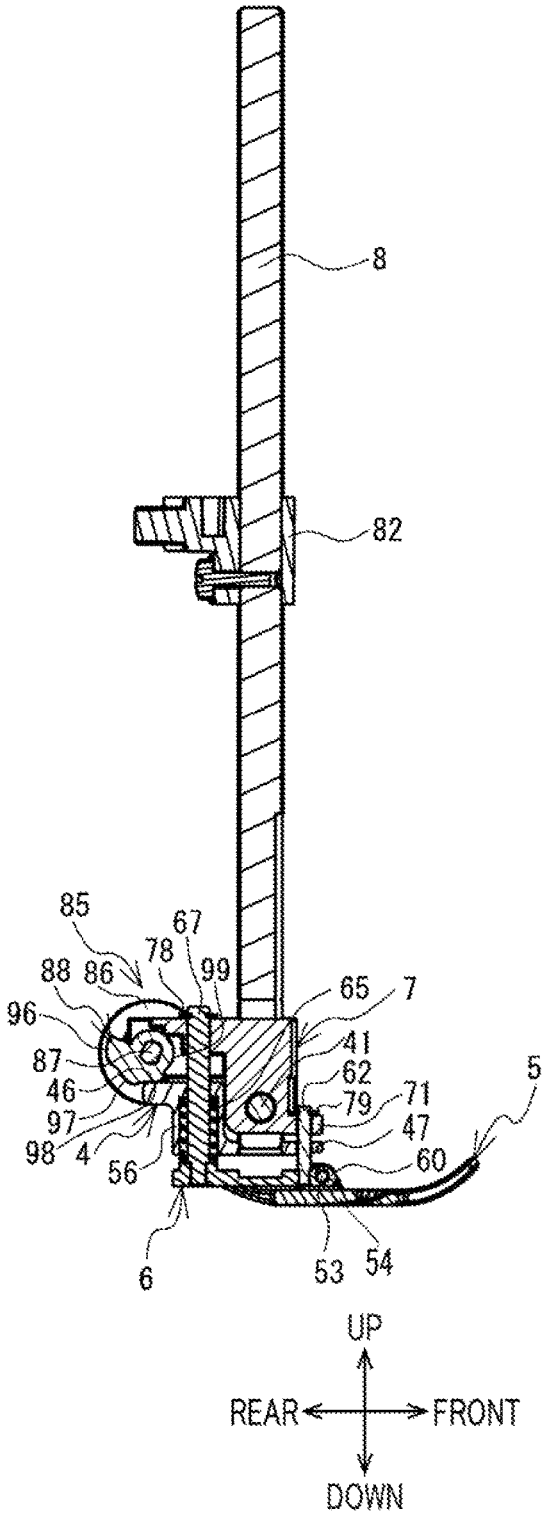

FIG. 9A illustrates a cross-sectional view of the presser bar and the pressing device on which the presser foot is mounted and in which the third surface portion of the gap-adjusting member is in contact with the contact part of the third member, the second member is in a second position relative to a first member, and an urging force of a presser bar spring is not transmitted to the presser foot.

Figure 9B:
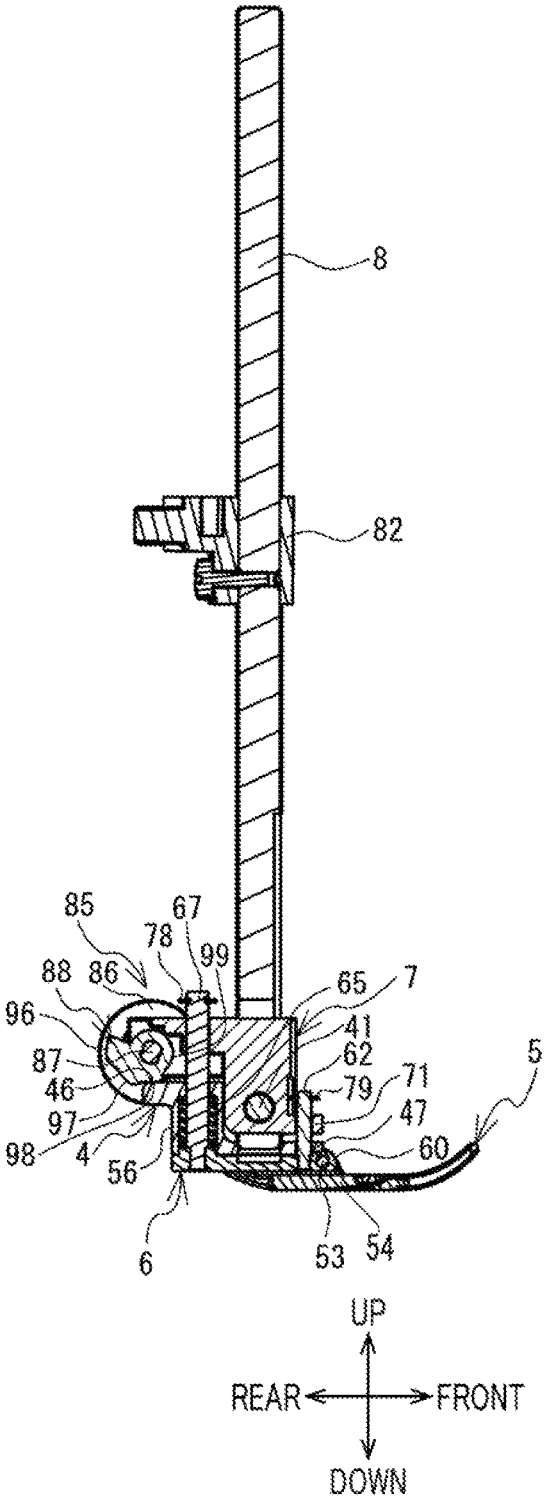

FIG. 9B illustrates a cross-sectional view of the presser bar and the pressing device on which the presser foot is mounted and in which the third surface portion of the gap-adjusting member is in contact with the contact part of the third member, the second member is in a first position relative to a first member, and an urging force of a presser bar spring is transmitted to the presser foot.

Figure 10:
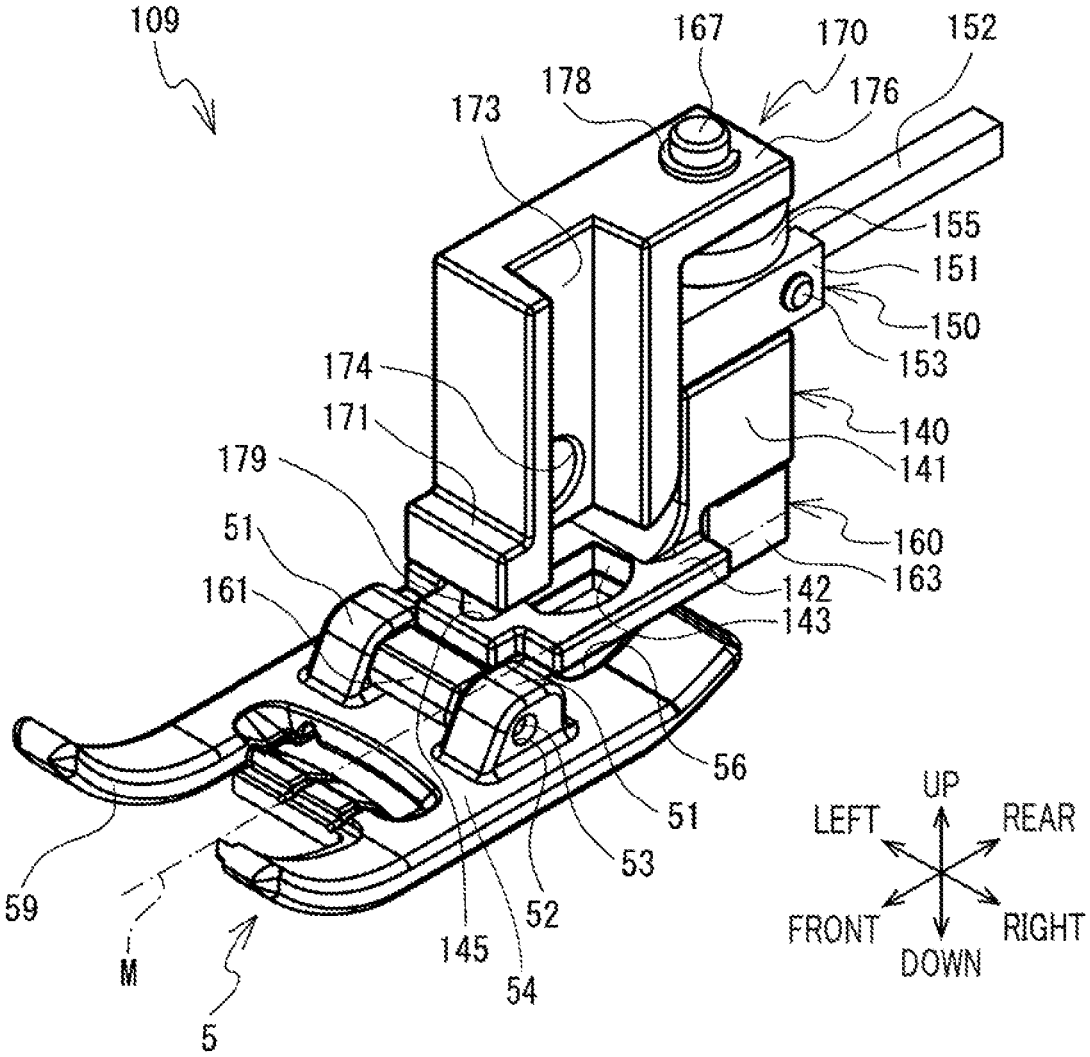

FIG. 10 illustrates a perspective view of a pressing device according to a first variation on which a presser foot is mounted.

Figure 11A:
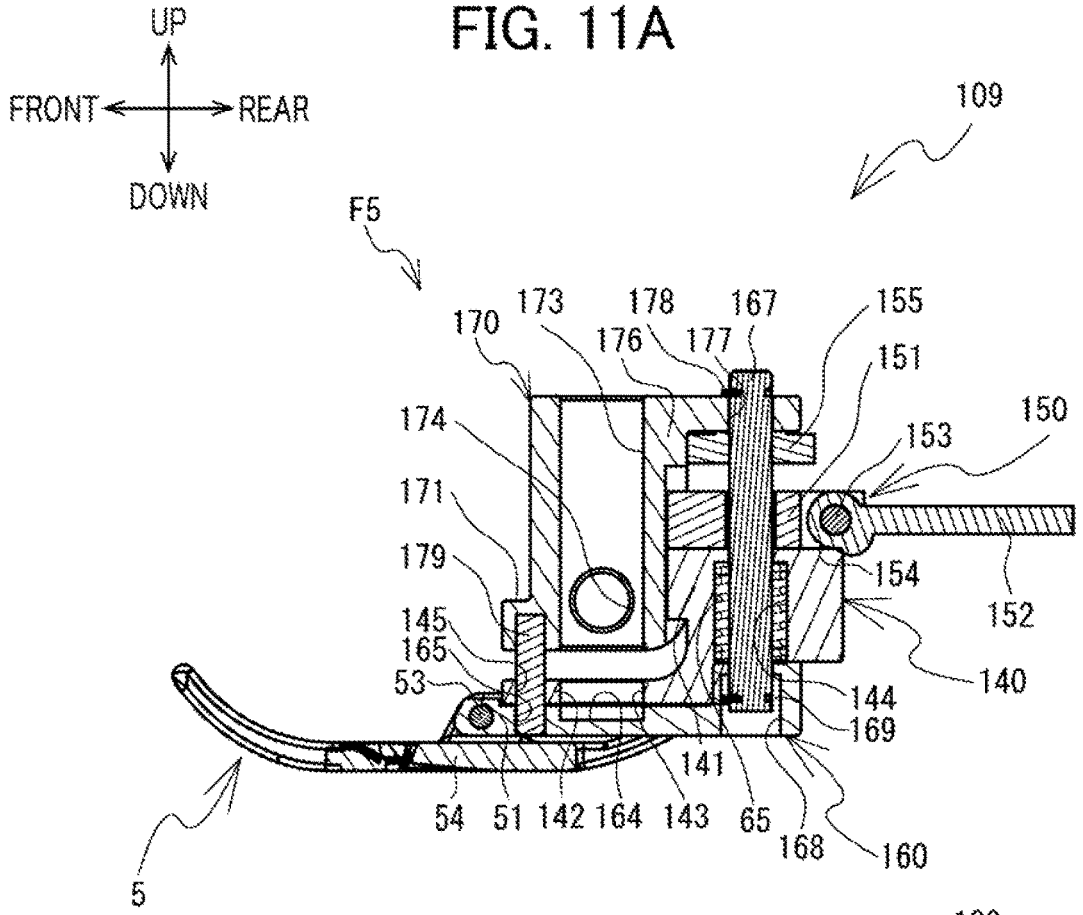

FIG. 11A illustrates a cross-sectional view of the pressing device and the presser foot in state F5 in which the top of a feed dog is positioned above the top surface of a throat plate and a workpiece is not arranged between the presser foot and the throat plate.

Figure 11B:
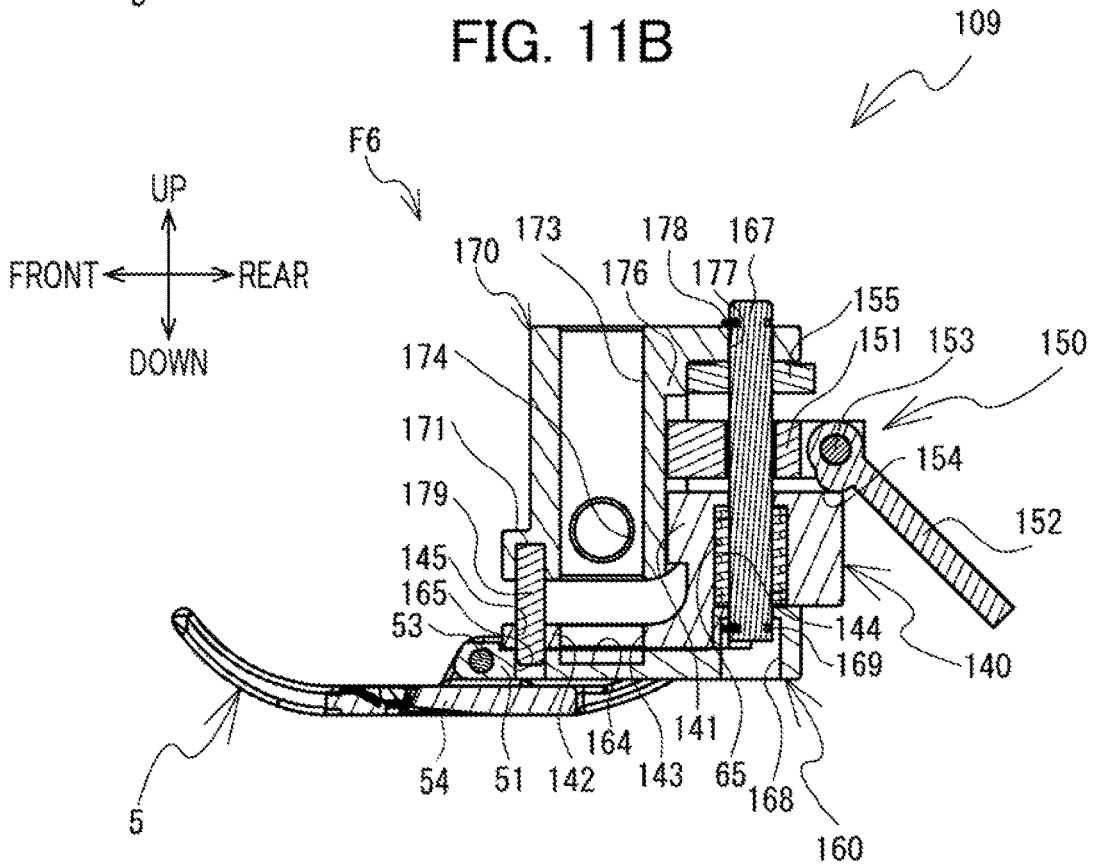

FIG. 11B illustrates a cross-sectional view of the pressing device and the presser foot in state F6 in which the top of the feed dog is positioned above the top surface of the throat plate and a workpiece is not arranged between the presser foot and the throat plate.

Figure 12:
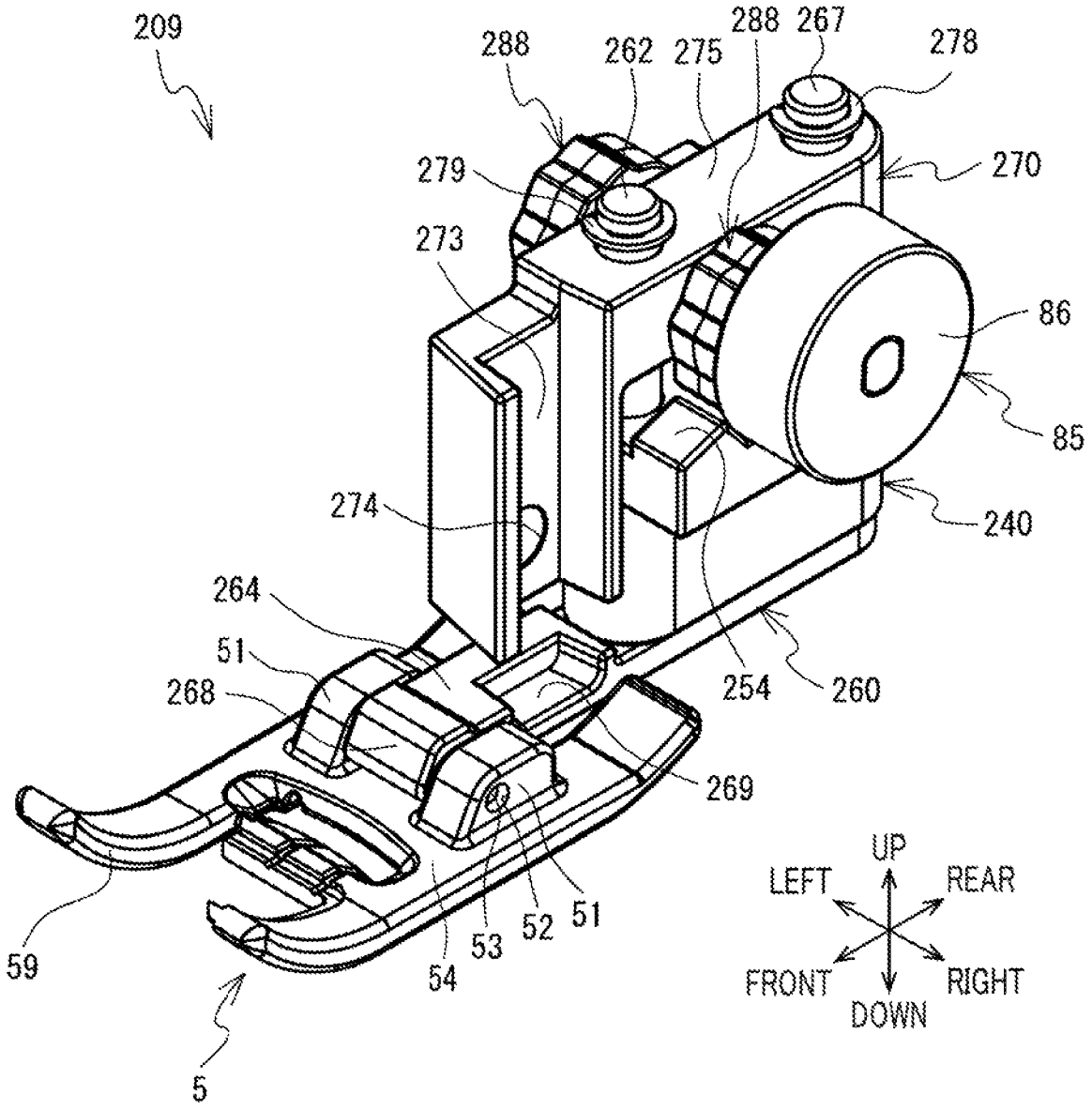

FIG. 12 illustrates a perspective view of a pressing device according to a second variation on which a presser foot is mounted.

Figure 13:
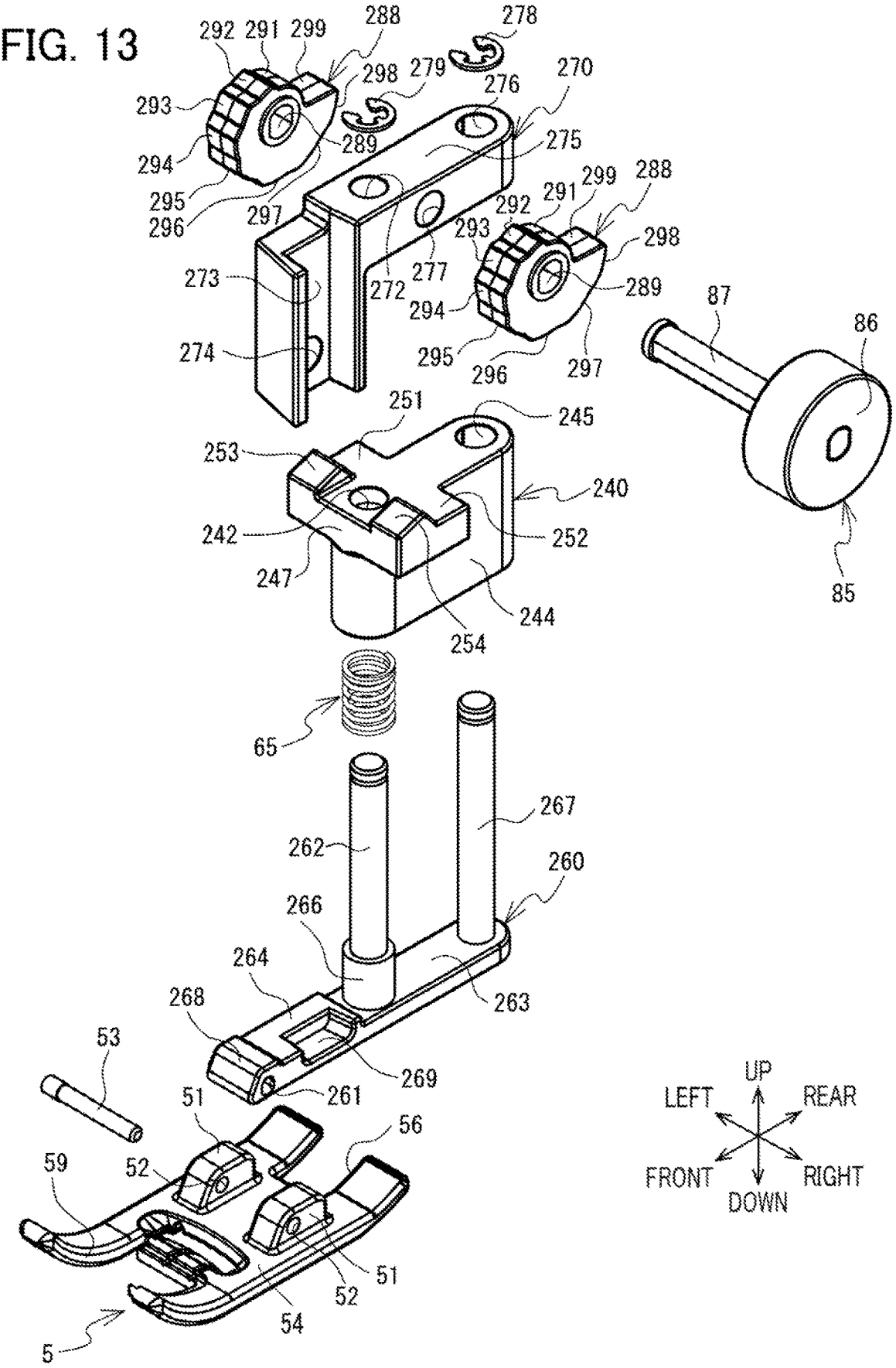

FIG. 13 illustrates an exploded perspective view of the pressing device and the presser foot illustrated in FIG. 12.

Next, an embodiment of the present disclosure will be described while referring to the accompanying drawings. The physical configuration of a sewing machine 1 provided with a pressing device 9 will be described with reference to FIGS. 1 and 2. The pressing device 9 of the present embodiment can sew curved lines and can easily switch between curved line sewing and normal sewing. Directions upward, downward, toward the lower-right, toward the upper-left, toward the lower-left, and toward the upper-right in FIG. 1 will indicate the top, bottom, right, left, front, and rear sides of the sewing machine 1 in which the pressing device 9 is mounted. The longitudinal directions of a bed section 11 and an arm section 13 are aligned with the left-right direction of the sewing machine 1. The side of the sewing machine 1 in which a column section 12 is arranged constitutes the right side of the sewing machine 1. The direction in which the column section 12 extends is the up-down direction relative to the sewing machine 1.

Figure 1:
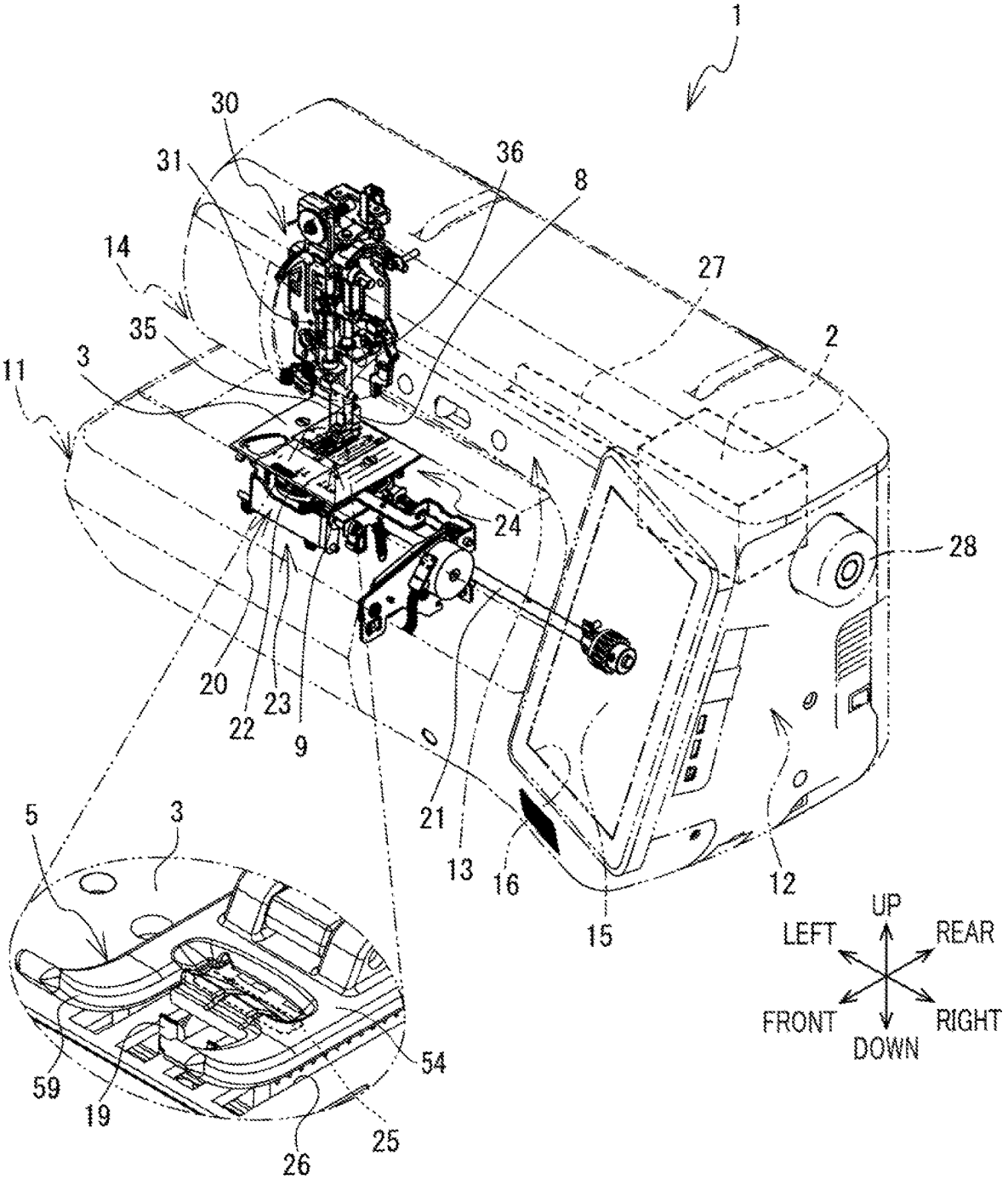
FIG. 1 illustrates a perspective view of a sewing machine in which a pressing device is mounted.
Figure 2:
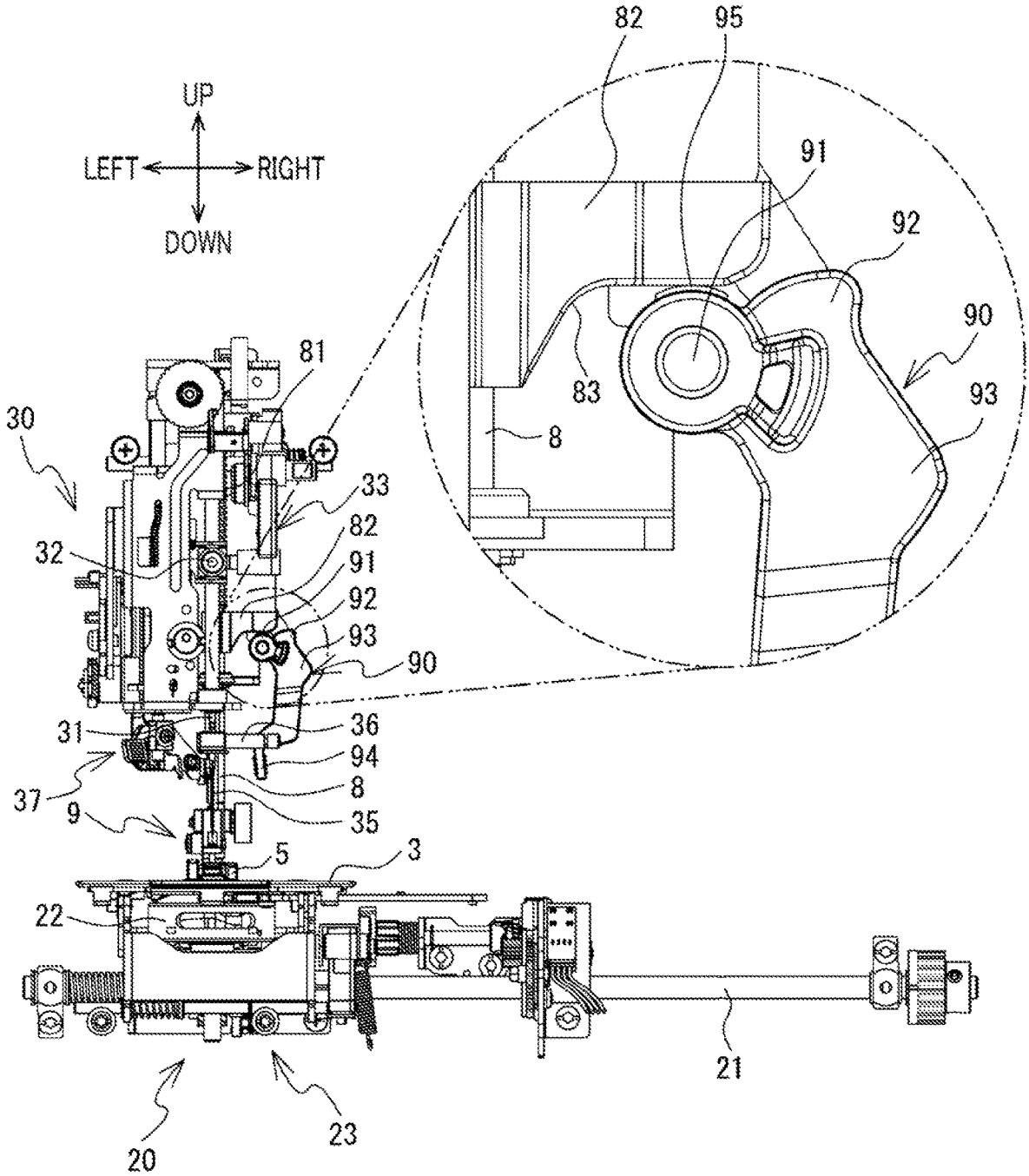
FIG. 2 illustrates a front view of a presser bar with the pressing device mounted on the lower end portion thereof, a needle bar mechanism, and a rotary hook mechanism in the sewing machine.

As illustrated in FIGS. 1 and 2, the sewing machine 1 includes the bed section 11, the column section 12, the arm section 13, and a head section 14. The bed section 11 is the base portion of the sewing machine 1 that extends in the left-right direction. The bed section 11 includes a throat plate 3 provided on the top surface thereof. Beneath the throat plate 3, the bed section 11 includes a rotary hook mechanism 20, a feed dog 19, a feed mechanism 23, and a feed dog drop mechanism 24. The rotary hook mechanism 20 includes a lower shaft 21, and a horizontal rotary hook 22. The horizontal rotary hook 22 rotates along with the rotation of the lower shaft 21 to loop a needle thread (not illustrated) around a bobbin thread (not illustrated) beneath the throat plate 3. The throat plate 3 has a plate-like shape that extends horizontally. The throat plate 3 is formed with a needle hole 25 through which a needle 35 passes, and slits 26 extending in the front-rear direction.

Figure 7A:
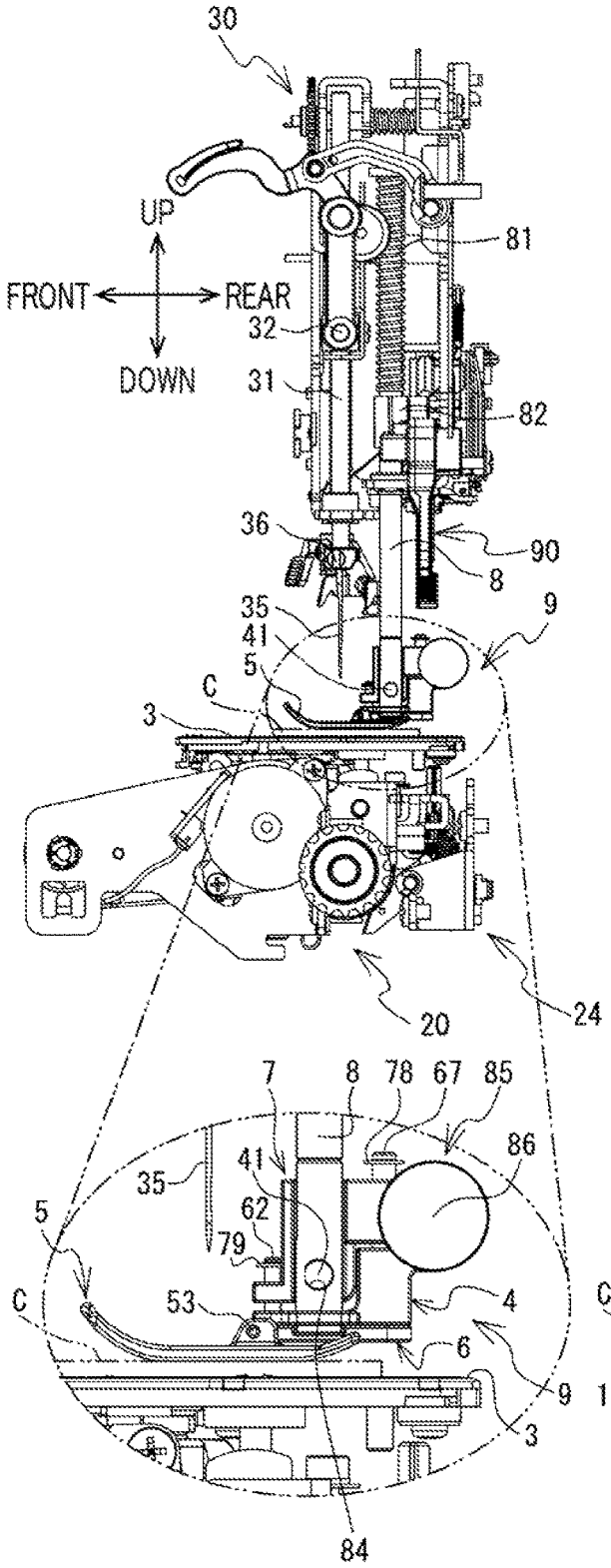
FIG. 7A illustrates a right-side view of the pressing device, the needle bar mechanism, and the rotary hook mechanism in the sewing machine with the bottom end of the needle positioned above a throat plate and the top of a feed dog retracted below the top surface of the throat plate.
Figure 7B:
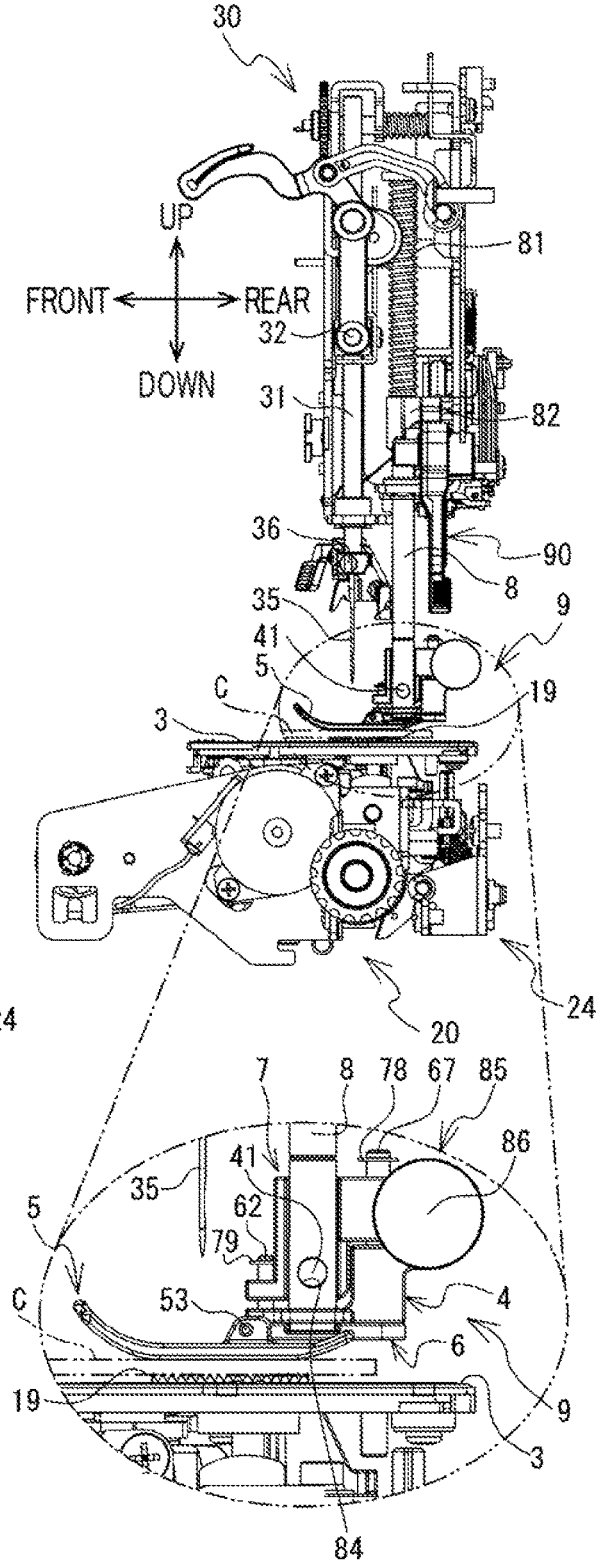
FIG. 7B illustrates a right-side view of the pressing device, the needle bar mechanism, and the rotary hook mechanism in the sewing machine with the bottom end of the needle positioned above the throat plate and the top of the feed dog positioned above the top surface of the throat plate.

The feed dog 19 retractably emerges from the slits 26 formed in the throat plate 3 for feeding a workpiece C placed on the throat plate 3 (see FIGS. 7A and 7B). When driven by a sewing machine motor 2 described below, the feed mechanism 23 drives the feed dog 19 to convey the workpiece C rearward or forward. The feed dog drop mechanism 24 is configured to move only the feed dog 19 below the throat plate 3 independently from the drive of the sewing machine motor 2. The user operates a touchscreen 16 described below to input instructions for moving the feed dog 19 to a prescribed position with the feed dog drop mechanism 24. On the basis of these instructions, the sewing machine 1 can control a drive force of the feed dog drop mechanism 24 to change the position of the feed dog 19 independently from the drive of the sewing machine motor 2.

The column section 12 is erected upward from the right end portion of the bed section 11. The sewing machine motor 2 is provided inside the upper portion of the column section 12. A liquid crystal display (LCD) 15 is provided on the front surface of the column section 12. The touchscreen 16 is provided over the front surface of the LCD 15. A pulley 28 is provided on the right surface of the column section 12.

The arm section 13 extends leftward from the upper end of the column section 12 parallel to the bed section 11. The head section 14 is coupled with the left end portion of the arm section 13. Provided in the head section 14 are a needle bar 31, a needle bar mechanism 30, a threading mechanism 37, a presser bar 8, and the like. A needle clamp 36 is fixed to the lower end portion of the needle bar 31. The needle 35 is detachably fixed by the needle clamp 36. The needle 35 can be mounted on the lower end portion of the needle bar 31 via the needle clamp 36.

The needle bar mechanism 30 includes the sewing machine motor 2, a spindle 27, a link mechanism 33, and a needle bar clamp 32. The spindle 27 rotates in response to the drive of the sewing machine motor 2 to transmit the drive of the sewing machine motor 2 to the needle bar 31 via the link mechanism 33 and needle bar clamp 32 illustrated in FIG. 2. The needle bar clamp 32 is fixed to the needle bar 31. The needle bar mechanism 30 moves the needle bar 31 in the up-down direction in response to the drive of the sewing machine motor 2. The spindle 27 also rotates when the user rotates the pulley 28. The threading mechanism 37 is configured to pass the needle thread through an eye (not illustrated) of the needle 35.

As illustrated in FIG. 2, the presser bar 8 extends in the up-down direction on the rear side of the needle bar 31. The presser bar 8 moves in the up-down direction in synchronization with the drive of the sewing machine motor 2, and more specifically in synchronization with the drive of the feed dog 19. Provided at the presser bar 8 are a presser bar spring 81, a presser bar clamp 82, and a lever 90. The presser bar spring 81 urges the presser bar 8 downward. The presser bar spring 81 is a coil spring placed around the presser bar 8. The presser bar clamp 82 is fixed to the presser bar 8 and contacts the lower end of the presser bar spring 81 to define the position of the lower end of the presser bar spring 81.

The lever 90 switches the position of the presser bar 8 in the up-down direction by being manually operated. The lever 90 includes a shaft 91, protrusions 92 and 93, a contact part 95, and an operating part 94. The shaft 91 is provided inside the head section 14. The protrusions 92 and 93 are portions of the lever 90 near the shaft 91 that protrude away from the shaft 91. The contact part 95 is a convex part disposed on the periphery of the shaft 91 to the left of the protrusion 92 and protrudes away from the shaft 91.

The operating part 94 is the portion of the lever 90 farthest from the shaft 91. By operating the operating part 94 with a finger or other actuator, the user can rotate the lever 90 clockwise or counterclockwise in a front view about the shaft 91 in order to switch the presser bar 8 between a raised position and a lowered position. FIG. 2 illustrates a state in which the operating part 94 is below the shaft 91 and the presser bar 8 is in the lowered position. When the presser bar 8 is in the lowered position, the contact part 95 is positioned above the shaft 91.

If the operating part 94 is rotated counterclockwise in a front view from the state in FIG. 2 until the operating part 94 is positioned on the lower right of the shaft 91, the protrusion 92 of the lever 90 contacts a bottom surface 83 of the presser bar clamp 82, moving the presser bar 8 to the raised position. When the presser bar 8 is in the raised position, a portion of the lever 90 between the protrusion 92 and protrusion 93 contacts the bottom surface 83 of the presser bar clamp 82. The user performs operations for placing or retrieving a workpiece C while the presser bar 8 is in the raised position.

The sewing machine 1 allows either the pressing device 9 or a conventional pressing device to be detachably mounted on the lower end portion of the presser bar 8. When a conventional pressing device is mounted on the presser bar 8 and the presser bar 8 is in the lowered position, a presser foot 5 described below contacts the workpiece C on the throat plate 3 and presses the workpiece C downward. When a conventional pressing device is mounted on the presser bar 8, the presser bar clamp 82 coupled with the presser bar 8 in the sewing machine 1 does not contact the lever 90 of the sewing machine 1 as the needle bar 31 reciprocates in the up-down direction (i.e., moves upward and downward).

In other words, when a conventional pressing device is mounted on the presser bar 8 and the presser bar 8 is in the lowered position, the presser bar clamp 82 is spaced apart from the lever 90 while the needle bar 31 of the sewing machine 1 reciprocates in the up-down direction (i.e., moves upward and downward) so that the urging force of the presser bar spring 81 is constantly transmitted to the presser foot 5. On the other hand, when the pressing device 9 of the present embodiment is mounted on the presser bar 8 and the presser bar 8 is in the lowered position, the pressing device 9 can switch whether the urging force of the presser bar spring 81 is constantly transmitted to the presser foot 5 or not while the needle bar 31 reciprocates in the up-down direction (i.e., moves upward and downward).

Figure 3:
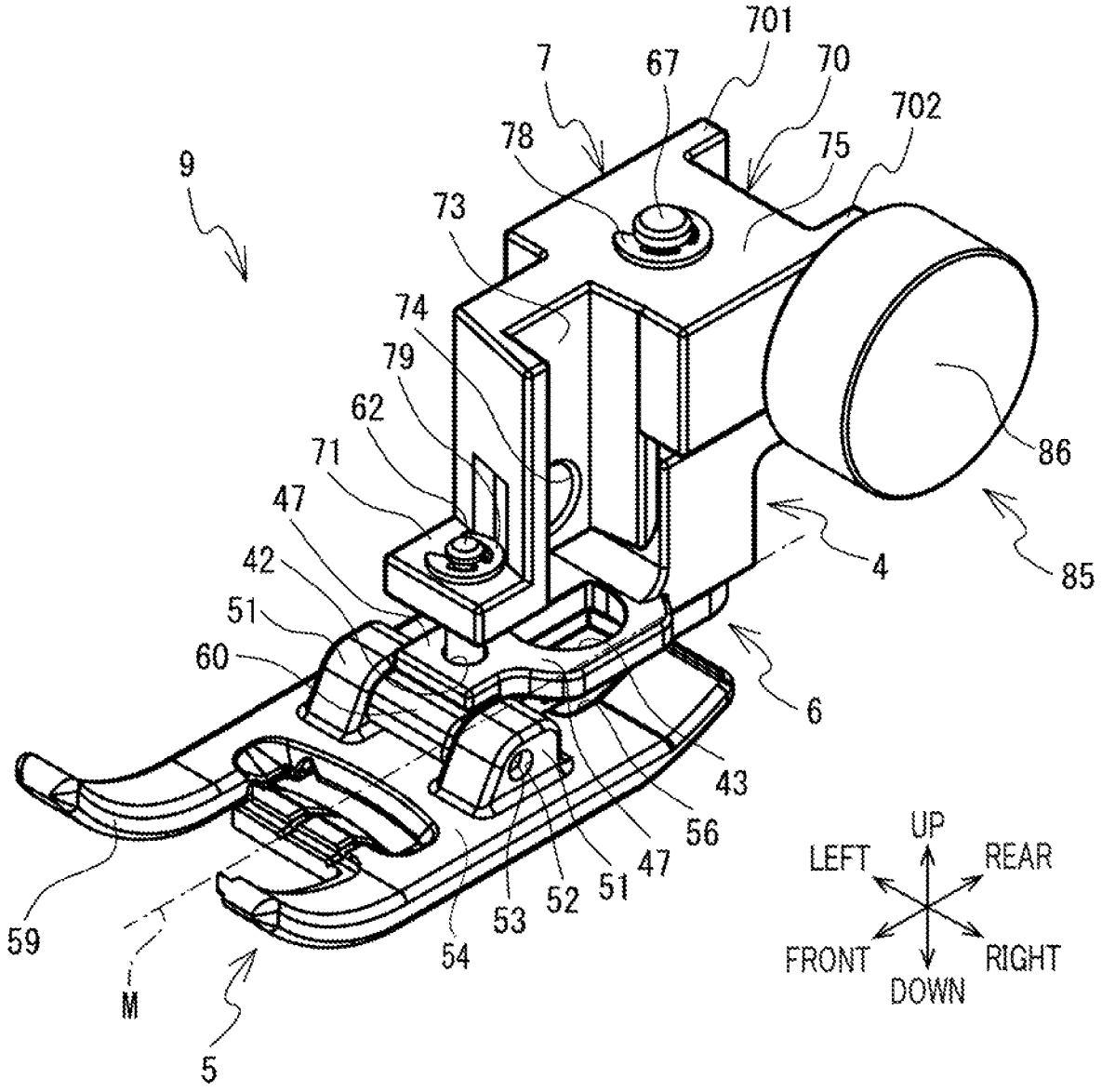
FIG. 3 illustrates a perspective view of the pressing device on which a presser foot is mounted.
Figure 4:
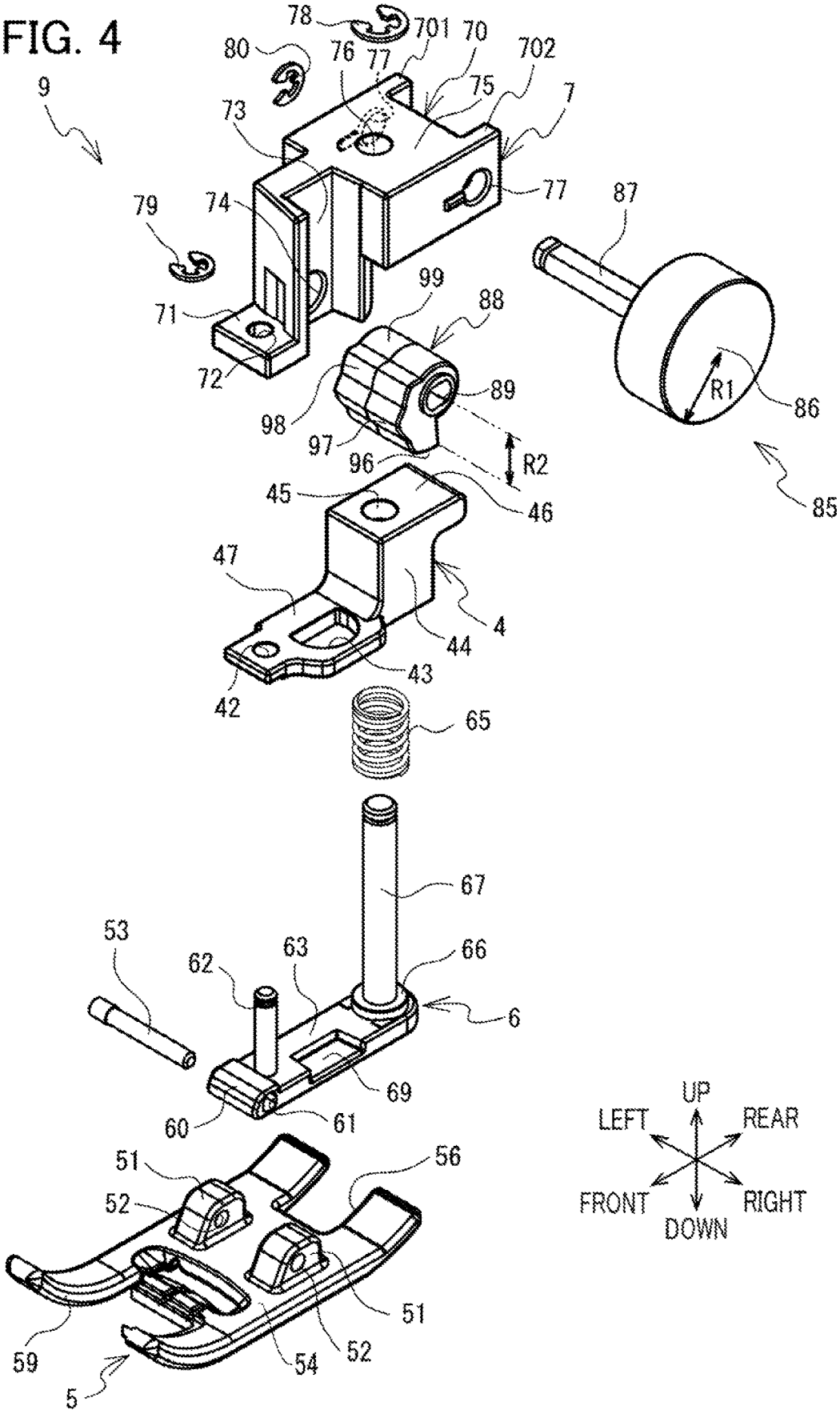
FIG. 4 illustrates an exploded perspective view of the pressing device and the presser foot.

As illustrated in FIGS. 3 and 4, the presser foot 5 includes a main portion 54 having a plate-like shape that is rectangular in a plan view and is elongated in the front-rear direction. Both the front end portion and rear end portion of the main portion 54 are curved upward. The main portion 54 is formed with a notch 59 in the front portion thereof. The main portion 54 is formed with a notch 56 in the rear portion thereof.

In a plan view, the notch 59 is formed in an R-shape along a left-right center M of the main portion 54 and extends rearward from the front edge of the main portion 54. When the pressing device 9 that supports the presser foot 5 is mounted on the lower end portion of the presser bar 8 and the sewing machine 1 is driven, the needle 35 passes through the rear portion of the notch 59. In a plan view, the notch 56 is formed in a rectangular shape along the left-right center M of the main portion 54 and extends forward from the rear edge of the main portion 54 of the presser foot 5.

The presser foot 5 also includes a pair of shaft supports 51, and a shaft 53 extending in the left-right direction. The shaft supports 51 are parts protruding upward from the top surface of the main portion 54 at positions rearward of the notch 59 and forward of the notch 56. The shaft supports 51 extend in the front-rear direction and are spaced apart from each other in the left-right direction. Each of the shaft supports 51 is formed with a hole 52 penetrating therethrough in the left-right direction. While inserted into the holes 52, the shaft 53 is held by the shaft supports 51.

As illustrated in FIGS. 3 and 4, the pressing device 9 includes a first member 7, a second member 6, a third member 4, a gap-adjusting member 88, an urging member 65, a guide part 67, a restricting part 62, and a shaft part 85. The first member 7 has a mounting part 73 that is mounted on the presser bar 8 of the sewing machine 1. While the mounting part 73 is mounted on the presser bar 8, the first member 7 moves in the up-down direction along with the presser bar 8 which is urged downward. Hereinafter, a state in which the mounting part 73 of the first member 7 is mounted on the presser bar 8, i.e., a state in which the pressing device 9 is mounted in the sewing machine 1 will be also called a mounted state.

The first member 7 further includes a main portion 75, and a front portion 71. The main portion 75 is a portion having a C-shape in a plan view with the mounting part 73 recessed leftward from the right side thereof. The left side of the main portion 75 is formed with a circular hole 74 that penetrates the same in the left-right direction and is in communication with the mounting part 73. The circular hole 74 is circular in a side view. The main portion 75 is formed with an insertion hole 76 to the rear of the mounting part 73. The insertion hole 76 penetrates the main portion 75 in the up-down direction. The front portion 71 protrudes forward from the lower portion on the front side of the main portion 75. The front portion 71 is formed with an insertion hole 72 that penetrates the same in the up-down direction. The insertion hole 72 has a circular shape in a plan view. The main portion 75 has a support part 70 recessed downward and forward from the upper rear portion thereof. The support part 70 has a left wall 701 and a right wall 702. Each of the left wall 701 and right wall 702 is formed with an insertion hole 77 in the rear portion thereof. Each insertion hole 77 penetrates the corresponding left wall 701 and right wall 702 in the left-right direction. A rotational shaft 87 described later is inserted into the insertion holes 77.

The second member 6 supports the presser foot 5, which is pressed downward on a workpiece C placed on the bed section 11 of the sewing machine 1. The second member 6 has a plate-like shape that is rectangular in a plan view. The second member 6 includes a main portion 63, a contact part 66, and a front portion 60. The main portion 63 has a horizontal plate-like shape elongated in the front-rear direction. The length of the main portion 63 of the second member 6 in the up-down direction is smaller than the length of the first member 7 in the up-down direction. The main portion 63 is formed with a recess 69. The recess 69 is a downwardly recessed part in the front-rear center region of the main portion 63.

The guide part 67 guides movement of the second member 6 relative to the first member 7. The guide part 67 is a shaft fixed to the second member 6. The guide part 67 has a column-like shape that protrudes upward from the top surface of the main portion 63 at a position rearward of the recess 69. The length of the guide part 67 in the up-down direction is greater than the length of the main portion 75 of the first member 7 in the up-down direction. With the urging member 65 mounted around the guide part 67, the guide part 67 is inserted into an insertion hole 45 formed in the third member 4 described later. The guide part 67 is further inserted into the insertion hole 76 formed in the first member 7 above a main portion 44 described later in which the insertion hole 45 is formed. A retaining ring 78 is mounted on the top end of the guide part 67 after the guide part 67 has been inserted through both the first member 7 and third member 4 in the up-down direction. The retaining ring 78 defines the range of movement in the up-down direction for the first member 7 relative to the second member 6. By inserting the guide part 67 through the insertion hole 76 of the first member 7, the insertion hole 76 restricts movement in the horizontal direction of the first member 7 relative to the second member 6. By inserting the guide part 67 through the insertion hole 45 of the third member 4, the insertion hole 45 restricts movement in the horizontal direction of the third member 4 relative to the second member 6.

The contact part 66 is a cylindrical protrusion provided to the rear of the recess 69. The contact part 66 has a ring-like shape in a plan view and surrounds the guide part 67. The contact part 66 protrudes upward from the top surface of the main portion 63.

The urging member 65 is a coil spring. As illustrated in FIGS. 5A through 5D, the upper end of the urging member 65 is in contact with a contact part 761 provided in the third member 4 described later, while the lower end of the urging member 65 is in contact with the contact part 66 of the second member 6. In the mounted state where the first member 7 is mounted on the presser bar 8, the urging member 65 urges the second member 6 and third member 4 away from each other with an urging force smaller than the pressing force of the presser bar 8, i.e., the urging force of the presser bar spring 81.

The restricting part 62 has a column-like shape that protrudes upward from the top surface of the main portion 63 at a position forward of the recess 69 and rearward of the front portion 60. The restricting part 62 extends parallel to the guide part 67. The length of the restricting part 62 in the up-down direction is smaller than the length of the guide part 67 in the up-down direction. The restricting part 62 is inserted through an insertion hole 42 formed in the third member 4 described later and the insertion hole 72 of the first member 7. A retaining ring 79 is mounted on the top end of the restricting part 62 after the restricting part 62 has been inserted through the first member 7 and third member 4 in the up-down direction. The retaining ring 79 defines the range of movement in the up-down direction for the first member 7 relative to the second member 6. In the mounted state where the first member 7 is mounted on the presser bar 8, the restricting part 62 and guide part 67 are arranged with the mounting part 73 therebetween in the front-rear direction, which crosses the longitudinal direction of the presser bar 8, i.e., the up-down direction. Both the restricting part 62 and the guide part 67 are fixed to the second member 6.

The front portion 60 protrudes forward from the front side of the main portion 63. The front portion 60 is formed with a hole 61 that penetrates the front portion 60 in the left-right direction. When the presser foot 6 is being mounted on the second member 6, the second member 6 is placed between the pair of shaft supports 51 in the presser foot 5 in the left-right direction and the shaft 53 is inserted through the hole 61. The second member 6 supports the presser foot 5 to be pivotable around the shaft 53.

The third member 4 is disposed between the first member 7 and second member 6 in the up-down direction. The third member 4 includes a main portion 44, and a front plate portion 47. The main portion 44 has an inverted L-shape when viewed from the right side. The main portion 44 is formed with an insertion hole 45 in the upper portion thereof. The insertion hole 45 penetrates the main portion 44 in the up-down direction. The insertion hole 45 has a circular shape in a plan view. The part of the top surface on the main portion 44 to the rear of the insertion hole 45 is a contact part 46 that contacts the gap-adjusting member 88.

The front plate portion 47 has a plate-like shape extending forward from the lower-front end of the main portion 44. The front plate portion 47 is formed with insertion holes 42 and 43. Each of the insertion holes 42 and 43 penetrates the front plate portion 47 in the up-down direction. The insertion hole 42 is a circular-shaped hole in a plan view formed in the front portion of the front plate portion 47. The insertion hole 42 receives insertion of the restricting part 62. The insertion hole 43 is a semicircular hole in a plan view with the convex side on the right and is formed between the insertion hole 42 and main portion 44. The presser bar 8 is inserted through the insertion hole 43. In a state where the third member 4 is arranged above the second member 6, a portion of the recess 69 formed in the second member 6 is positioned beneath the insertion hole 43.

The gap-adjusting member 88 is configured to change the gap between the first member 7 and the third member 4 by contacting the contact part 46 of the third member 4. The gap-adjusting member 88 is formed with an insertion hole 89 that is elliptical in a side view and penetrates the gap-adjusting member 88 in the left-right direction. A rotational shaft 87 of the shaft part 85 described later is inserted through the insertion hole 77 formed in the right wall 702, the insertion hole 89, and the insertion hole 77 formed in the left wall 701, and is supported by the support part 70 of the first member 7 rearward of the insertion hole 76 through which the guide part 67 is inserted. A retaining ring 80 is mounted on the left end portion of the rotational shaft 87.

The gap-adjusting member 88 is disposed between the left wall 701 and right wall 702 of the support part 70 in the left-right direction. The gap-adjusting member 88 is provided closer to the guide part 67 than to the restricting part 62. In other words, the distance in the front-rear direction between the gap-adjusting member 88 and restricting part 62 is greater than the distance in the front-rear direction between the gap-adjusting member 88 and guide part 67. In the mounted state where the pressing device 9 is mounted on the lower end portion of the presser bar 8, the guide part 67 and gap-adjusting member 88 are arranged on the same side of the presser bar 8, i.e., both the guide part 67 and gap-adjusting member 88 are arranged on the rear side of the presser bar 8. However, the restricting part 62 and gap-adjusting member 88 are arranged on different sides of the presser bar 8. In other words, the restricting part 62 is provided on the front side of the presser bar 8 while the gap-adjusting member 88 is provided on the rear side of the presser bar 8. In a plane parallel to both the longitudinal direction of the presser bar 8, i.e., the up-down direction, and the front-rear direction, a line connecting the contact point between the gap-adjusting member 88 and contact part 46 and the axial center of the rotational shaft 87 inserted through the insertion hole 89 is perpendicular to the contact part 46 and parallel to the longitudinal direction of the presser bar 8, i.e., the up-down direction. Therefore, the gap-adjusting member 88 will not rotate inadvertently when receiving a force from the presser bar spring 81.

The gap-adjusting member 88 in the present embodiment is a cam that can rotate about the rotational shaft 87 supported by the first member 7 to change the gap between the first member 7 and third member 4 in multiple steps. The gap-adjusting member 88 includes surface portions 96 through 99. Each of the surface portions 96 through 99 has a curved surface that extends parallel to the rotational center of the rotational shaft 87. Each of the surface portions 96 through 99 is positioned a different distance from the rotational center of the rotational shaft 87. That is, the distance from the rotational center of the rotational shaft 87 decreases in order of the surface portions 96 through 99. The compressed amount of the urging member 65 changes according to the gap between the contact part 66 of the second member 6 and the contact part 761 of the third member 4 in the up-down direction.

The shaft part 85 includes the rotational shaft 87 and a dial 86. The dial 86 is provided on one end portion of the rotational shaft 87 for rotating the cam (i.e., gap-adjusting member 88). The dial 86 is mounted on the right end portion of the rotational shaft 87 in the mounted state where the pressing device 9 is mounted on the presser bar 8. The radius R1 of the dial 86 is larger than the maximum radius R2 of the gap-adjusting member 88. When viewed in a direction parallel to the rotational center of the rotational shaft 87, the gap-adjusting member 88 is inside the contour of the dial 86. The dial 86 may be provided with graduation markings and the like used to indicate the positions corresponding to the surface portions 96 through 99 that are to be in contact with the contact part 46 of the third member 4.

The state of the pressing device 9 changes among states F1 through F4 depending on what surface portion of the gap-adjusting member 88 is in contact with the contact part 46 of the third member 4, and the position of the third member 4 relative to the first member 7 in the up-down direction is different for each of these states. The third member 4 is in contact with the second member 6 in the up-down direction at a transmission time when the urging force of the presser bar spring 81 is being transmitted to the presser foot 5. In other words, the top of the feed dog 19 in the sewing machine 1 is raised above the throat plate 3 at the transmission time illustrated in states F1 through F4.

Figure 5A:
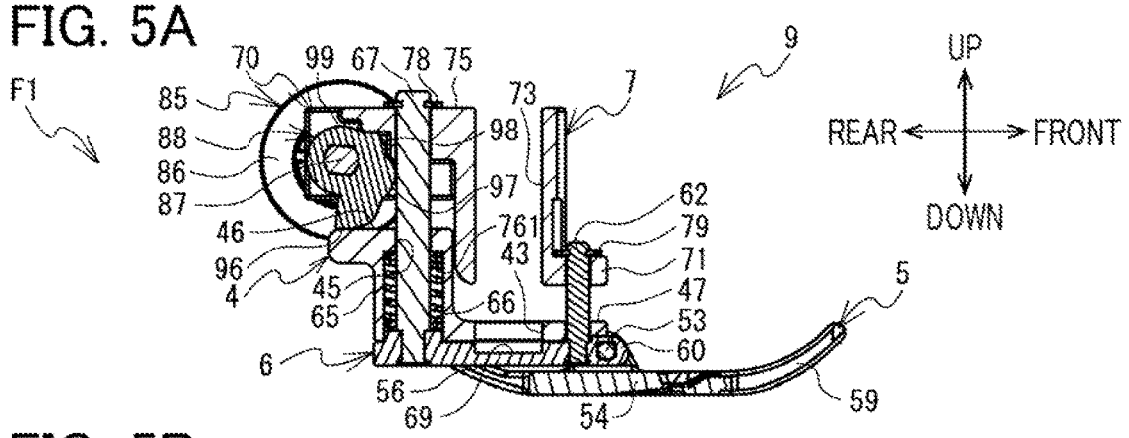
FIG. 5A illustrates a cross-sectional view of the pressing device and the presser foot in state F1 in which a first surface portion of a gap-adjusting member is in contact with a contact part of a third member.

Specifically, state F1 illustrated in FIG. 5A shows the transmission time while the first surface portion 96 of the gap-adjusting member 88 is in contact with the contact part 46. In state F1, the gap between the front portion 71 of the first member 7 and the front plate portion 47 of the third member 4 in the up-down direction is the largest among states F1 through F4. Additionally, in state F1, the main portion 75 of the first member 7 is preferably in contact with the retaining ring 78 while the front portion 71 of the first member 7 is preferably in contact with the retaining ring 79, but the first member 7 is assembled so that at least the spaced amount (i.e., gap) between either the main portion 75 and retaining ring 78 or the front portion 71 and retaining ring 79 in the up-down direction is near zero. That is, in state F1 the second member 6 and third member 4 are always in contact with each other in the up-down direction so that the urging force of the presser bar spring 81 is transmitted to the presser foot 5, regardless of the rise or fall in the feed dog 19. Accordingly, the pressing device 9 suppresses rotational movement of the workpiece C such as cloth in the same manner as a conventional pressing device.

Figure 5B:
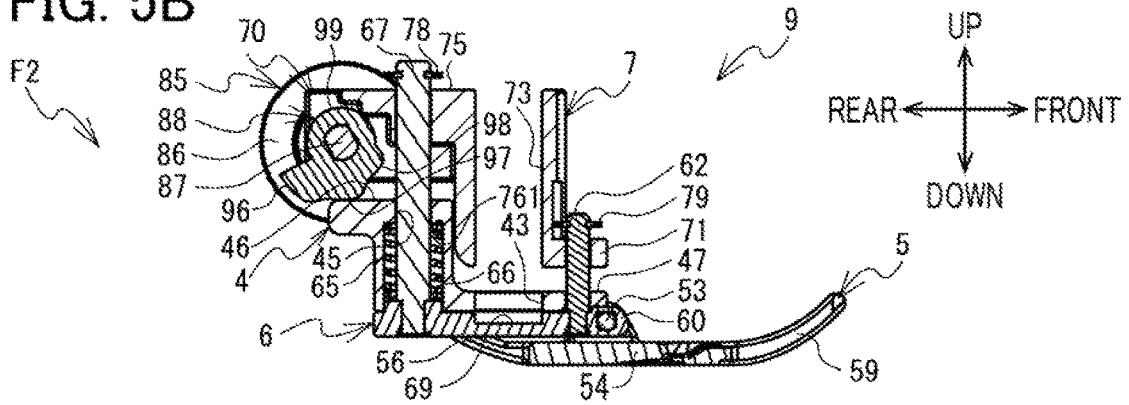
FIG. 5B illustrates a cross-sectional view of the pressing device and the presser foot in state F2 in which a second surface portion of the gap-adjusting member is in contact with the contact part of the third member.

State F2 illustrated in FIG. 5B shows the transmission time while the second surface portion 97 of the gap-adjusting member 88 is in contact with the contact part 46. In state F2, the gap between the front portion 71 of the first member 7 and the front plate portion 47 of the third member 4 in the up-down direction is the second largest among states F1 through F4. Here, the main portion 75 of the first member 7 is spaced apart from the retaining ring 78 in the up-down direction, and the front portion 71 of the first member 7 is spaced apart from the retaining ring 79 in the up-down direction.

Figure 5C:
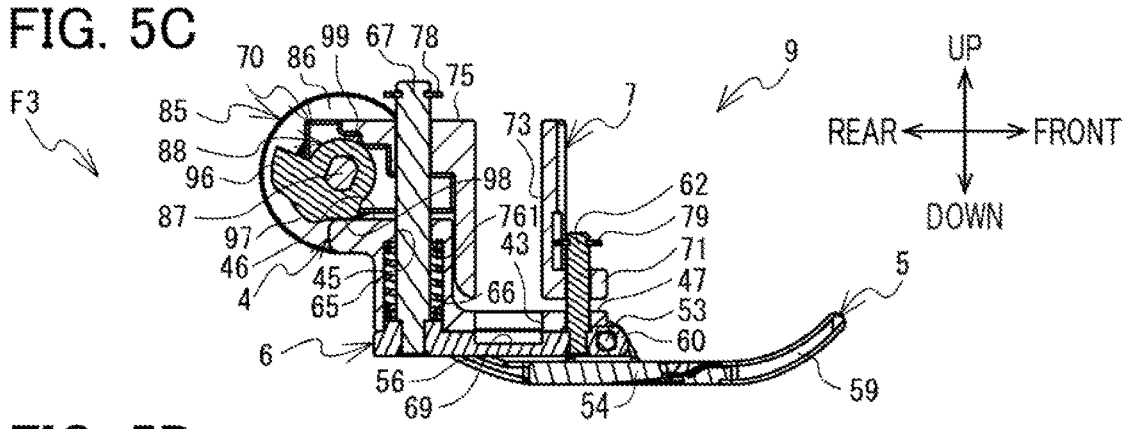
FIG. 5C illustrates a cross-sectional view of the pressing device and the presser foot in state F3 in which a third surface portion of the gap-adjusting member is in contact with the contact part of the third member.

State F3 illustrated in FIG. 5C shows the transmission time while the third surface portion 98 of the gap-adjusting member 88 is in contact with the contact part 46. In state F3, the gap between the front portion 71 of the first member 7 and the front plate portion 47 of the third member 4 in the up-down direction is the third largest among states F1 through F4. Here, the main portion 75 of the first member 7 is spaced apart from the retaining ring 78 in the up-down direction, and the front portion 71 of the first member 7 is spaced apart from the retaining ring 79 in the up-down direction.

Figure 5D:
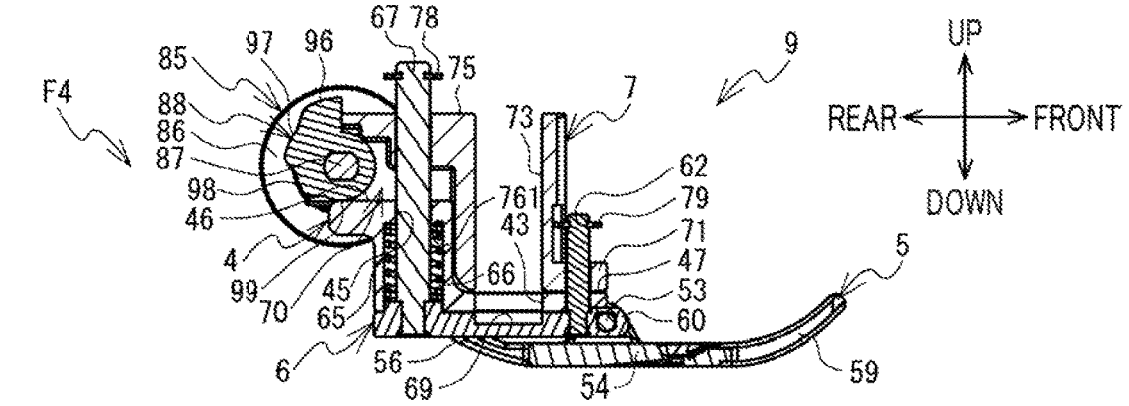
FIG. 5D illustrates a cross-sectional view of the pressing device and the presser foot in state F4 in which a fourth surface portion of the gap-adjusting member is in contact with the contact part of the third member.

State F4 illustrated in FIG. 5D shows the transmission time while the fourth surface portion 99 of the gap-adjusting member 88 is in contact with the contact part 46. In state F4, the gap between the front portion 71 of the first member 7 and the front plate portion 47 of the third member 4 in the up-down direction is the fourth largest among states F1 through F4, i.e., the smallest among states F1 through F4. Here, the front portion 71 of the first member 7 is slightly spaced apart from the front plate portion 47 of the third member 4 in the up-down direction, but the front portion 71 of the first member 7 may be in contact with the front plate portion 47 of the third member 4 in the up-down direction. The main portion 75 of the first member 7 is spaced apart from the retaining ring 78 in the up-down direction, and the front portion 71 of the first member 7 is spaced apart from the retaining ring 79 in the up-down direction.

In other words, in states F2 through F4, the main portion 75 of the first member 7 is spaced apart from the retaining ring 78 in the up-down direction, and the front portion 71 of the first member 7 is spaced apart from the retaining ring 79 in the up-down direction. Among all states F1 through F4, the gap between the main portion 75 of the first member 7 and the retaining ring 78 in the up-down direction is the largest in state F4, and the gap between the front portion 71 of the first member 7 and the retaining ring 79 in the up-down direction is the largest in state F4.

The user places the first surface portion 96 of the gap-adjusting member 88 in contact with the contact part 46, as shown in state F1, when the user would like the urging force of the presser bar spring 81 to be constantly transmitted to the presser foot 5 while the needle bar 31 of the sewing machine 1 reciprocates in the up-down direction (i.e., moves upward and downward) in the same manner as a conventional pressing device. When the user would like the urging force of the presser bar spring 81 to be transmitted to the presser foot 5 only in prescribed periods of time during which the top of the feed dog 19 is above the throat plate 3 as the needle bar 31 reciprocates in the up-down direction and the urging force of the urging member 65 rather than the urging force of the presser bar spring 81 to be transmitted to the presser foot 5 outside of those prescribed periods of the time, the user places one of the surface portions 97 through 99 of the gap-adjusting member 88 in contact with the contact part 46, as shown in states F2 through F4, depending on the thickness of the workpiece C.

In the present embodiment, the second surface portion 97 of the gap-adjusting member 88 is suitable for workpieces C having a thickness no greater than 1 mm, the third surface portion 98 of the gap-adjusting member 88 is suitable for workpieces C having a thickness greater than or equal to 1 mm and less than or equal to 2 mm, and the fourth surface portion 99 of the gap-adjusting member 88 is suitable for workpieces C having a thickness greater than or equal to 2 mm and less than or equal to 3 mm. The amount of change by which the gap-adjusting member 88 changes the gap of the third member 4 relative to the first member 7 in the up-down direction may be modified as needed.

With the pressing device 9 mounted on the lower end portion of the presser bar 8, that is in the mounted state of the pressing device 9, the gap-adjusting member 88 can adjust the gap between the first member 7 and third member 4 to change the position of the third member 4 in the up-down direction according to the thickness of the workpiece C, so that the presser bar clamp 82 coupled with the presser bar 8 of the sewing machine 1 transitions between a state in which the presser bar clamp 82 is in contact with the lever 90 and a state in which the presser bar clamp 82 is spaced apart from the lever 90 during one reciprocal movement of the needle bar 31 of the sewing machine 1 in the up-down direction. The contact of the presser bar clamp 82 with the lever 90 causes the lever 90 to define the lower end of the range of movement in the up-down direction for the presser bar 8. In this case, the second member 6 moves between a first position and a second position relative to the first member 7 during one reciprocal movement of the needle bar 31 in the up-down direction. The first position of the second member 6 is a position in which the pressing force of the presser bar 8, i.e., the urging force of the presser bar spring 81, is transmitted to the presser foot 5. The second position of the second member 6 is a position in which the pressing force of the presser bar 8 is not transmitted to the presser foot 5.

Specifically, when the third surface portion 98 of the gap-adjusting member 88 is in contact with the contact part 46, the first position is the position in which the front plate portion 47 of the third member 4 is in contact with the front portion 60 of the second member 6, as illustrated in FIG. 9B, and the second position is a position in which the front plate portion 47 of the third member 4 is spaced apart from the front portion 60 of the second member 6, as illustrated in FIG. 9A. The second member 6 can also move between the first position and second position relative to the first member 7 when the second surface portion 97 or fourth surface portion 99 of the gap-adjusting member 88 is in contact with the contact part 46.

Figure 6A:
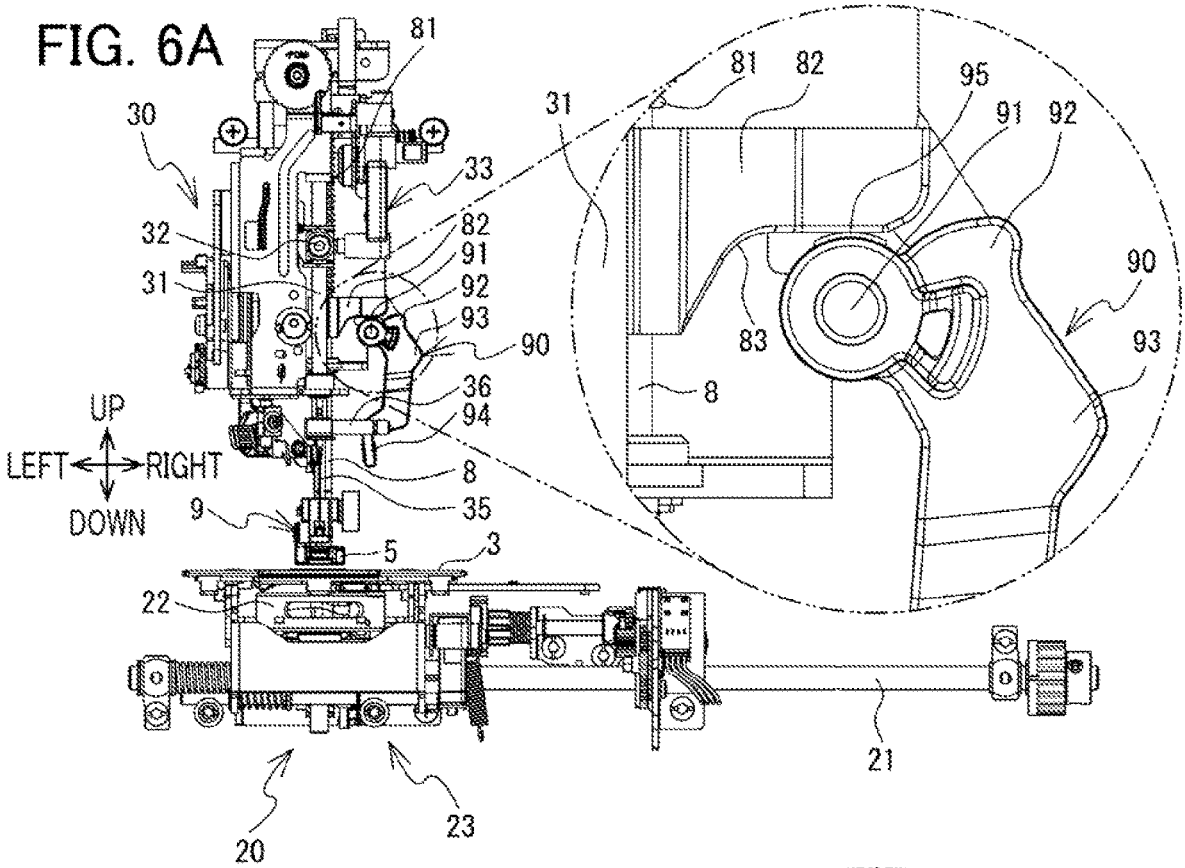
FIG. 6A illustrates a front view of the pressing device, the needle bar mechanism, and the rotary hook mechanism in the sewing machine with the bottom end of a needle positioned above a throat plate and the top of a feed dog retracted below the top surface of the throat plate.

Next, a method of mounting the pressing device 9 on the presser bar 8 will be described with reference to FIGS. 6A and 7A. In response to a user instruction, the sewing machine 1 drives the feed dog drop mechanism 24 to retract the top of the feed dog 19 below the top surface of the throat plate 3 while the bottom end of the needle 35 is positioned above the throat plate 3. The user screws a screw 41 into a threaded hole 84 of the presser bar 8 (see FIGS. 7A and 7B) to mount the first member 7 of the pressing device 9 on the lower end portion of the presser bar 8. The user operates the dial 86 to adjust the position of the third member 4 relative to the first member 7 in the up-down direction according to the thickness of the workpiece C.

The positions of the presser bar clamp 82 and the presser bar 8 in the up-down direction change in accordance with the position of the feed dog 19 in the up-down direction. By operating the dial 86, the user can switch whether the third member 4 is at a position in the up-down direction where the bottom surface 83 of the presser bar clamp 82 comes into contact with the contact part 95 of the lever 90 during reciprocal movement of the needle bar 31 of the sewing machine 1 in the up-down direction so that the lever 90 defines the lower end of the range of movement for the presser bar 8. More specifically, after the pressing device 9 has been mounted according to the mounting method described above, when the feed dog 19 is raised, the presser foot 5 is raised accordingly and the second member 6 comes into contact with the third member 4. When the feed dog 19 is further raised while the second member 6 and third member 4 are in contact with each other, the presser bar 8 moves upward together with the presser bar clamp 82, causing the presser bar clamp 82 to be spaced apart from the contact part 95 of the lever 90. In other words, the presser bar clamp 82 switches between contacting the contact part 95 of the lever 90 or spaced apart from the contact part 95 of the lever 90 in accordance with the top position of the feed dog 19.

Figure 6B:
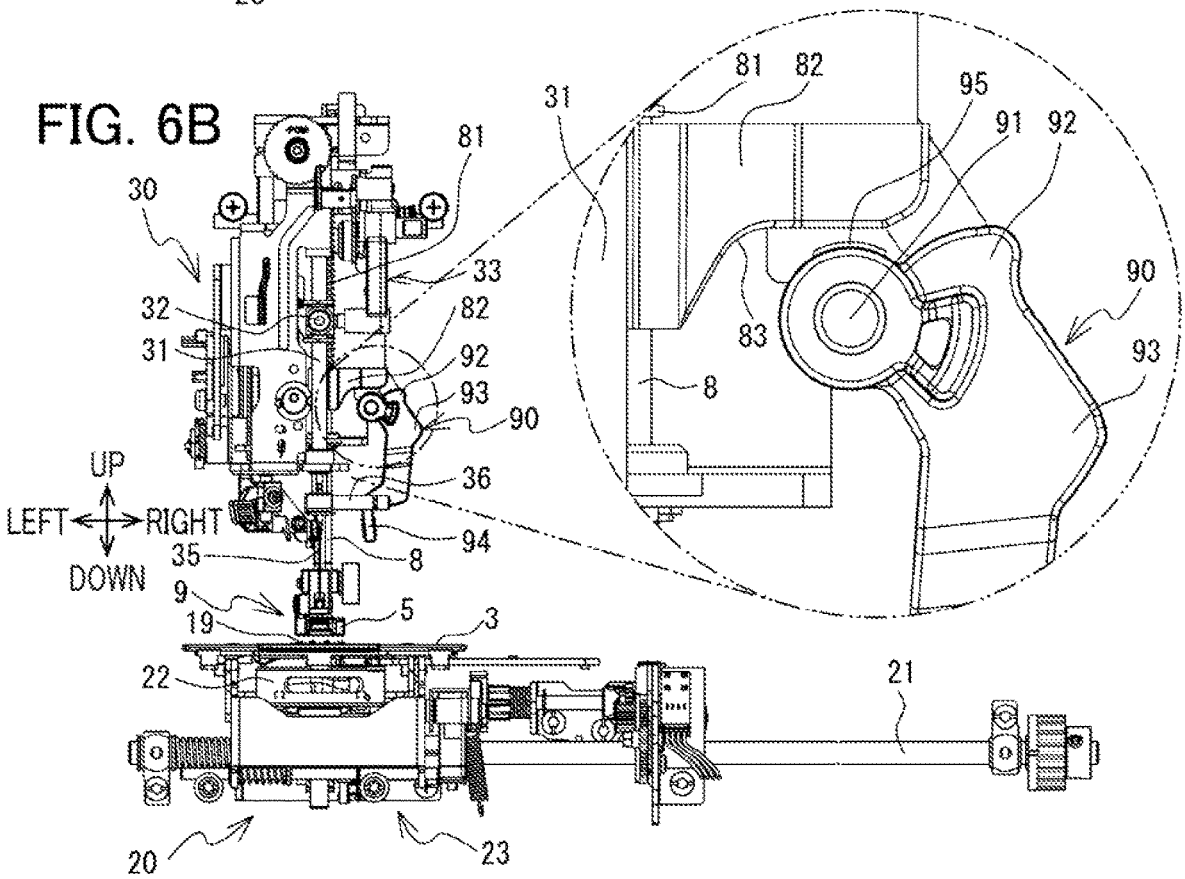
FIG. 6B illustrates a front view of the pressing device, the needle bar mechanism, and the rotary hook mechanism in the sewing machine with the bottom end of the needle positioned above the throat plate and the top of the feed dog positioned above the top surface of the throat plate.

Here, the second member 6 is in the first position during prescribed periods of time when the bottom end of the needle 35 is above the throat plate 3, as illustrated in FIGS. 6B, 7B, and 9B. The prescribed periods of time are periods in which the top of the feed dog 19 is positioned above the throat plate 3 to cause the presser bar 8 to be raised above the feed dog 19 through the presser foot 5 and pressing device 9 and the presser bar clamp 82 to be spaced apart from the contact part 95 of the lever 90. The prescribed periods of time in the present embodiment are the periods indicated by P1 in FIG. 8. In the first position, the second member 6 transmits a downwardly pressing force from the presser bar 8 to the presser foot 5.

On the other hand, when the bottom end of the needle 35 is below the throat plate 3, the second member 6 is in the second position, as illustrated in FIG. 9A. When in the second position, the second member 6 does not transmit the pressing force from the presser bar 8 to the presser foot 5. When the bottom end of the needle 35 is below the throat plate 3, the presser bar 8 is not raised by the feed dog 19 since the top of the feed dog 19 is positioned below the top surface of the throat plate 3. Therefore, the presser bar 8 is in a position where the bottom surface 83 on the presser bar clamp 82 is in contact with the contact part 95 of the lever 90 and does not drop any lower regardless of the position of the needle bar 31 in the up-down direction. In this state, the urging force of the presser bar spring 81 is applied to the lever 90 and not to the presser foot 5 via the pressing device 9, as shown in FIG. 8.

In FIG. 8, the pressing force applied to the presser foot 5 during a period P2 is expressed on the basis of the assumption that the pressing force applied during periods P1 is 100. However, the "PRESSING FORCE TO PRESSER FOOT" indicated in FIG. 8 ignores minute changes due to displacement of the urging member 65 and minute changes due to displacement of the presser bar spring 81 accompanying movement of the feed dog 19 in the up-down direction. The pressing force applied to the presser foot 5 during the period P2 is smaller than the pressing force applied to the presser foot 5 during the period P1.

While the feed dog 19 moves from the position at which the bottom surface 83 of the presser bar clamp 82 contacts the contact part 95 of the lever 90 to the position at which the top of the feed dog 19 comes below the throat plate 3, the second member 6 is lowered through the urging force of the urging member 65 to a position at which the presser foot 5 contacts the workpiece C. As a result, the front plate portion 47 of the third member 4 is spaced apart from the front portion 60 of the second member 6 in the up-down direction.

In a state where the first member 7 is mounted on the presser bar 8 of the sewing machine 1 and the second member 6 is in the second position, the second member 6 transmits the urging force of the urging member 65 to the presser foot 5. Thus, while the first member 7 is mounted on the presser bar 8 of the sewing machine 1 and the second member 6 supports the presser foot 5, the second member 6 is disposed in the second position during periods P2 in which the presser bar clamp 82 is in contact with the contact part 95 of the lever 90 and is disposed in the first position during periods P1 in which the presser bar clamp 82 is spaced apart from the contact part 95 of the lever 90. In other words, the position of the second member 6 is switched in accordance with the position of the top of the feed dog 19 in the up-down direction.

The following is a description of the results of experiments conducted both when using the pressing device 9 of the present embodiment and when using a conventional pressing device to evaluate the ease of changing the orientation of the workpiece C relative to the throat plate 3 during sewing. In these evaluation experiments, sixteen evaluators were asked to sew arbitrary circles and curved lines using both the pressing device 9 in the present embodiment, whereby the pressing force applied to the presser foot 5 changes while the needle bar 31 of the sewing machine 1 reciprocates in the up-down direction, and the conventional pressing device, and to evaluate the ease of changing the direction of the workpiece C relative to the throat plate 3 on a scale of 1 to 5. The sewing machine 1 used in these experiments was the CP100X manufactured by Brother Industries, Ltd., with a sewing speed of 420 rpm. The pressing force of the presser bar spring 81 was approximately 15.7 N, and the urging force of the urging member 65 was approximately 4.9 N. When using the conventional pressing device, the presser bar clamp 82 did not contact the contact part 95 of the lever 90 during sewing and the force applied to the workpiece C by the presser foot 5 was nearly constant. When using the pressing device 9 of the present embodiment, the presser bar clamp 82 contacted the contact part 95 of the lever 90 during sewing, and the pressing force applied to the workpiece C by the presser foot 5 during periods P2 in FIG. 8 was less than that during periods P1.

The average of evaluation values on the ease of sewing curved lines when using the pressing device 9 as compared to when using the conventional pressing device was 4.38, with 5 being "good", 4 being "somewhat good", 3 being "average", 2 being "somewhat poor", and 1 being "poor". The above results confirm that the pressing device 9 of the present embodiment enables the orientation of the workpiece C relative to the throat plate 3 to be changed more easily during sewing than the conventional pressing device by transmitting the pressing force of the presser bar spring 81 to the presser foot 5, just as the conventional pressing device, when the workpiece C is being conveyed by the feed dogs 19, but applying a lesser force than the conventional pressing device to the presser foot 5 during the periods P2 when the needle 35 is piercing the workpiece C.

Next, a pressing device 109 according to a variation (first variation) of the embodiment will be described with reference to FIGS. 10 and 11. Components in FIGS. 10 and 11 that are the same as those in the embodiment described above are designated with the same reference numerals. As illustrated in FIGS. 10 and 11, the pressing device 109 includes a first member 170, a second member 160, a third member 140, a gap-adjusting member 150, the urging member 65, a guide part 167, and a restricting part 179.

The first member 170 includes a main portion 176, and a front portion 171. The main portion 176 has a mounting part 173 formed therein. The mounting part 173 is recessed leftward from the right side of the main portion 176. The mounting part 173 of the first member 170 is formed with a hole 174 for fixing the first member 170 to the lower end portion of the presser bar 8 with a screw 41 (see FIG. 7A). The pressing device 109 is mounted on the lower end of the presser bar 8 with the screw 41 inserted through the hole 174 according to the same procedure described in the embodiment for mounting the pressing device 9. The hole 174 penetrates the left side of the main portion 176 and is in communication with the mounting part 173. The main portion 176 is formed with an insertion hole 177 to the rear of the mounting part 173. The insertion hole 177 penetrates the main portion 176 in the up-down direction.

The front portion 171 has a plate-like shape that protrudes forward from the lower portion on the front side of the main portion 176. The restricting part 179 is a columnar-shaped member that is fixed to the front portion 171. The restricting part 179 extends downward from the bottom surface of the front portion 171.

As in the embodiment described above, the second member 160 supports the presser foot 5. The second member 160 has a plate-like shape that is rectangular in a plan view. The second member 160 includes a main portion 163 and a front portion 161. The main portion 163 has a plate-like shape that is elongated in the front-rear direction. The length of the main portion 163 in the up-down direction is smaller than the length of the first member 170 in the up-down direction. The main portion 163 is formed with an insertion hole 168 in the rear portion thereof. The insertion hole 168 penetrates the main portion 163 in the up-down direction. The main portion 163 is formed with an insertion hole 165 in the front portion thereof. The insertion hole 165 penetrates the main portion 163 in the up-down direction. The main portion 163 is formed with a recess 164. The recess 164 is a downwardly recessed part in the front-rear center region of the main portion 163. The recess 164 is located forward of the insertion hole 168 and rearward of the insertion hole 165.

The guide part 167 is a columnar shaft extending in the up-down direction. The guide part 167 guides movement of the second member 160 relative to the first member 170. The guide part 167 is inserted into each of the insertion hole 177 in the first member 170, the insertion hole 168 in the second member 160, and an insertion hole 144 of the third member 140 described later. As shown in state F5 illustrated in FIG. 11A and state F6 illustrated in FIG. 11B, a retaining ring 178 is mounted on the top end of the guide part 167 after the guide part 167 has been inserted through both the front portion 171 of the first member 170 and a front plate portion 142 of the third member 140 described later in the up-down direction. The retaining ring 178 defines the range of movement in the up-down direction for the guide part 167 relative to the first member 170. A retaining ring 169 is mounted on the bottom end of the guide part 167. The retaining ring 169 defines the range of movement in the up-down direction for the second member 160 relative to the guide part 167. An insertion hole 143 formed in the third member 140 described later and the recess 164 in the second member 160 are provided at positions overlapping the mounting part 173 in a plan view.

The restricting part 179 is a columnar shaft that extends in the up-down direction. The restricting part 179 restricts the second member 160 from rotating about the guide part 167 relative to the first member 170. The restricting part 179 is inserted through both the insertion hole 165 in the second member 160 and an insertion hole 145 in the third member 140 described later.

The third member 140 includes a main portion 141 and a front plate portion 142. The main portion 141 has a rectangular parallelepiped shape. The main portion 141 is formed with an insertion hole 144 penetrating therethrough in the up-down direction. With the urging member 65 placed around the guide part 167, the guide part 167 is inserted into the insertion hole 144. The third member 140 receives an urging force from the urging member 65 in a direction away from the second member 160, i.e., an upwardly urging force.

The front plate portion 142 is a plate-like portion that protrudes forward from the bottom portion on the front side of the main portion 141. The front plate portion 142 is formed with insertion holes 143 and 145 penetrating therethrough in the up-down direction. The insertion hole 143 has a semicircular shape in a plan view, with the convex side on the right. The insertion hole 145 is a circular-shaped hole in a plan view formed to the front of the insertion hole 143. The restricting part 179 is inserted into the insertion hole 145.

The gap-adjusting member 150 is configured to change the gap between the first member and third member 140 by contacting the third member 140. The gap-adjusting member 150 includes a main portion 151, a lever 152, and a dial 155. The main portion 151 has a plate-like shape that is rectangular in a plan view. The guide part 156 is inserted through and fixed in the main portion 151. The main portion 151 rotatably supports the lever 152 about a rotational shaft 153 that extends in the left-right direction. The lever 152 has a protrusion 154 provided on the lower-front portion thereof. The protrusion 154 is semispherical in shape, with the convex side facing downward. The dial 155 is cylindrical in shape and has female threads on the inner circumferential surface thereof. The guide part 167 has male threads formed on a portion of the outer circumferential surface thereof in an area above the gap-adjusting member 150. The male threads of the guide part 167 is for engaging with the female threads of the dial 155. Hence, when the dial 155 is rotated about the guide part 167, the position of the guide part 167 relative to the dial 155 in the up-down direction changes, causing a change in the position of the main portion 151 relative to the first member 170 in the up-down direction.

Next, the procedure by which the gap-adjusting member 150 changes the gap between the front portion 171 of the first member 170 and the front plate portion 142 of the third member 140 in the up-down direction on the condition that the dial 155 is spaced apart from the main portion 151 in the up-down direction will be described with reference to FIGS. 11A and 11B.

The user mounts the pressing device 109 on the lower end portion of the presser bar 8 with the lever 152 in a horizontal orientation. The user then positions the bottom end of the needle above the throat plate 3. At this time, the top of the feed dog 19 is positioned above the throat plate 3. After arranging a workpiece C between the presser foot 5 and throat plate 3, the user operates the dial 155 to place the presser foot 5 in contact with the workpiece C, as shown in state F5.

Next, the user rotates the lever 152 clockwise in a right-side view, as shown in state F6. By rotating the lever 152, the protrusion 154 comes into contact with the top surface of the main portion 141 in the third member 140, and the third member 140 is pressed downward relative to the first member 170 against the urging force of the presser bar spring 81 along with the second member 160. In this state, the second member 160 moves downward relative to the third member 140 while the pressing force of the presser bar 8 is not being transmitted to the presser foot 5, and the urging force of the urging member 65 is transmitted to the presser foot 5.

In the pressing device 109 of the first variation, the user can perform operations to adjust the dial 155 on the condition that the top of the feed dog 19 has been dropped below the top surface of the throat plate 3 by the feed dog drop mechanism 24. In this case, the user does not rotate the lever 152 clockwise in a right-side view after adjusting the dial 155 but leaves the lever 152 in its horizontal orientation.

In the embodiment and its first variation, the sewing machine 1, the sewing machine motor 2, the throat plate 3, the feed dog 19, the slits 26, the feed mechanism 23, the presser bar 8, the bed section 11, the needle bar 31, the needle 35, the presser bar spring 81, and the presser bar clamp 82 are examples of the sewing machine, the sewing machine motor, the throat plate, the feed dog, the opening, the presser bar spring, and the presser bar clamp of the present disclosure, respectively. The pressing device 9 and the pressing device 109 are examples of the pressing device of the present disclosure. The urging member 65, the restricting part 62, and the presser foot 5 are examples of the urging member, the restricting part, and the presser foot of the present disclosure, respectively. The first member 7 and the first member 170 are examples of the first member of the present disclosure. The second member 6 and the second member 160 are examples of the second member of the present disclosure. The third member 4 and the third member 140 are examples of the third member of the present disclosure. The guide part 67 and the guide part 167 are examples of the guide part of the present disclosure. The gap-adjusting member 88 and the gap-adjusting member 150 are examples of the gap-adjusting member of the present disclosure. The rotational shaft 87 and the dial 86 are examples of the rotational shaft and the dial of the present disclosure, respectively. The insertion hole 76 and the insertion hole 177 are examples of the first insertion part of the present disclosure. The insertion hole 45 and the insertion hole 144 are examples of the second insertion part of the present disclosure. The insertion hole 72 is an example of the third insertion part of the present disclosure.

The sewing machine 1 in the embodiment described above includes the sewing machine motor 2, needle bar 31, throat plate 3, feed dog 19, feed mechanism 23, presser bar 8, and pressing device 9. The needle bar 31 extends in the up-down direction and has the lower end portion on which the needle 35 is mountable. The needle bar 31 is driven by the sewing machine motor 2 to move in the up-down direction. The throat plate 3 is formed with the needle hole 25 and the slits 26. The needle 35 passes through the needle hole 25 in accordance with movement of the needle bar in the up-down direction. The feed dog 19 can emerge from and be retracted beneath the slits 26 formed in the throat plate 3, and feeds a workpiece C placed on the throat plate 3. The feed mechanism 23 is driven by the sewing machine motor 2 to drive the feed dog 19. The presser bar 8 extends in the up-down direction and has a lower end portion on which the pressing device 9 is mountable. The presser bar 8 moves in the up-down direction in synchronization with the drive of the sewing machine motor 2. The pressing device 9 includes the first member 7, second member 6, third member 4, gap-adjusting member 88, urging member 65, and guide part 67. The first member 7 has the mounting part 73 which is mounted on the presser bar 8. In a mounted state in which the pressing device 9 is mounted on the presser bar 8, the first member 7 moves in the up-down direction along with the presser bar 8 which is urged downward. The second member 6 supports the presser foot 5 that presses the workpiece C placed on the throat plate 3 downward. Through the second member, the presser bar applies a pressing force to the presser foot downward. In the mounted state in which the pressing device 9 is mounted on the presser bar 8, the third member 4 is disposed between the first member 7 and second member 6 in the longitudinal direction of the presser bar 8, i.e., in the up-down direction, and is capable of moving in the up-down direction. The gap-adjusting member 88 can adjust the gap between the first member 7 and third member 4 by contacting the third member 4. The urging member 65 urges the second member 6 and third member 4 away from each other with an urging force smaller than the pressing force of the presser bar. The guide part guides movement of the second member 6 and third member 4 relative to the first member 7.

While the pressing device 9 of the sewing machine 1 is mounted on the presser bar 8, the position of the second member 6 relative to the first member 7 can be changed according to the position of the presser bar 8 in the up-down direction. Thus, in the mounted state, the pressing device 9 can change the pressing force that the presser foot 5 applies to the workpiece C through a simpler configuration than that of the conventional technology, i.e., without requiring the sewing machine 1 to have a complex structure such as a link mechanism or other connecting members.

By providing the pressing device 9 with the gap-adjusting member 88, the gap-adjusting member 88 can easily change the gap between the first member 7 and third member 4 after the pressing device 9 has been mounted on the presser bar 8 of the sewing machine 1. The second member 6 contacts the third member 4 in the up-down direction when the urging force of the presser bar spring 81 is transmitted to the presser foot 5. In other words, the position of the third member 4 relative to the first member 7 in the up-down direction defines the position of the second member 6 relative to the first member 7 in the up-down direction while the urging force of the presser bar spring 81 is transmitted to the presser foot 5.

The position of the first member 7 relative to the presser bar 8 in the up-down direction is defined by the circular hole 74 through which the screw 41 is inserted. Since the pressing device 9 includes the gap-adjusting member 88, the gap-adjusting member 88 can easily change the gap between the first member 7 and third member 4, i.e., the position of the second member 6 relative to the presser bar 8 in the up-down direction and the position of the presser foot 5 supported by the second member 6 relative to the presser bar 7 in the up-down direction when the urging force of the presser bar spring 81 is transmitted to the presser foot 5 after the pressing device 9 has been mounted on the presser bar 8.

With the pressing device 9 mounted on the presser bar 8, i.e., in the mounted state in which the pressing device 9 is mounted on the presser bar 8, the gap-adjusting member 88 can change the position of the third member 4 in the up-down direction so that the presser bar clamp 82 coupled with the presser bar 8 comes into contact with the lever 90 while the needle bar 31 of the sewing machine 1 reciprocates in the up-down direction to cause the lever 90 to define the lower end of the moving range of the presser bar 8. In this case, the second member 6 can move between a first position and a second position relative to the first member 7 while the needle bar 31 of the sewing machine 1 reciprocates in the up-down direction. In the first position, the pressing force of the presser bar 8 is transmitted to the presser foot 5. In the second position, the pressing force of the presser bar 8 is not transmitted to the presser foot 5. Therefore, in the mounted state, the pressing device 9 can switch whether the downwardly pressing force from the presser bar 8 is transmitted to the presser foot 5 supported by the second member 6 or not by changing the position of the second member 6 relative to the first member 7. After the pressing device 9 is mounted on the lower end portion of the presser bar 8, the pressing device 9 can easily set the second position with consideration for the thickness of the workpiece C by changing the gap between the first member 7 and third member 4.

The guide part 67 has a shaft-like shape or a hollow cylindrical shape, and is fixed to the second member 6. The first member 7 is formed with the insertion hole 76. When the guide part 67 is inserted through the insertion hole 76, the insertion hole 76 restricts movement of the second member 6 in directions crossing the up-down direction. The third member 4 is formed with the insertion hole 45. When the guide part 67 is inserted through the insertion hole 45, the insertion hole 45 restricts movement of the second member 6 in directions crossing the up-down direction. The urging member 65 is a coil spring placed around or inserted into the guide part 67. The compressed state of the coil spring is changed by adjusting the gap between the third member 4 and first member 7 with the gap-adjusting member 88. In the mounted state, the pressing device 9 can stably move the second member 6 and third member 4 relative to the first member 7 in the up-down direction through the relatively simple structure of the guide part 67 and urging member 65.

The pressing device 9 includes the restricting part 62. In the mounted state in which the pressing device 9 is mounted on the presser bar 8, the restricting part 62 is fixed to the second member 6 on the opposite side of the mounting part 73 from the guide part 67 in a direction perpendicular to the longitudinal direction of the presser bar 8, i.e., a direction perpendicular to the up-down direction. The restricting part 62 restricts the second member 6 from rotating about the guide part 67 relative to the first member 7. The restricting part 62 is inserted through the insertion hole 72 formed in the first member 7. The gap-adjusting member 88 is disposed closer to the guide part 67 than to the restricting part 62. The restricting part 62 of the pressing device 9 can suppress the second member 6 from rotating about the guide part 67 relative to the first member 7. Since the gap-adjusting member 88 is disposed relatively close to the urging member 65, which urges the second member 6 and third member 4, the operations for adjusting the gap between the second member 6 and third member 4 with the gap-adjusting member 88 are easier than if the gap-adjusting member 88 were disposed closer to the restricting part 62 than to the guide part 67.

The gap-adjusting member 88 has a cam that can change the gap between the first member 7 and third member 4 in multiple steps. The urging member 65 is a spring whose compressed amount is changed according to this gap. The gap-adjusting member 88 of the pressing device 9 can change the gap between the second member 6 and third member 4 through the simple structure of a cam.

The gap-adjusting member 88 has a cam that can rotate about the rotational shaft 87 supported by the first member 7 and can change the gap between the first member 7 and third member 4 in multiple steps. Since the gap-adjusting member 88 of the pressing device 9 can rotate about the rotational shaft 87, which is supported by the first member 7, the operations for adjusting the gap between the second member 6 and third member 4 with the cam can be simplified.

The pressing device 9 includes the dial 86 for rotating the cam. In the mounted state in which the pressing device 9 is mounted on the presser bar 8, the rotational shaft 87 extends in a direction perpendicular to the longitudinal direction of the presser bar 8, i.e., the up-down direction, and has an extending end portion on which the dial 96 is mounted. The dial 86 has a larger radius than the radius of the cam of the gap-adjusting member 88. The dial 86 of the pressing device 9 can simplify operations for adjusting the gap between the second member 6 and third member 4 with the cam.

In the mounted state in which the pressing device 9 is mounted on the presser bar 8, when the direction that the sewing machine 1 conveys the workpiece C is rearward, the rotational shaft 87 extends in the left-right direction, and the dial 86 is mounted on the right end portion of the rotational shaft 87. The dial 86 of the pressing device 9 helps simplify operations for adjusting the gap between the second member 6 and third member 4 with the cam, irrespective of whether the user is right-handed or left-handed.

The sewing machine 1 includes the lever 90, presser bar spring 81, and presser bar clamp 82. The lever 90 switches the position of the presser bar 8 in the up-down direction by being manually operated. The presser bar spring 81 urges the presser bar 8 downward. The presser bar clamp 82 is fixed to the presser bar 8 and defines the lower end position of the presser bar spring 81. During prescribed periods of time in which the bottom end of the needle 35 is positioned above the throat plate 3, the presser bar clamp 82 is spaced apart from the lever 90 to cause transmission of the urging force of the presser bar spring 81 to the second member 6 to be engaged. When the bottom end of the needle 35 is positioned beneath the throat plate 3, the presser bar clamp 82 contacts the lever 90 to cause the transmission of the urging force of the presser bar spring 81 to be disengaged. In the mounted state in which the pressing device 9 is mounted on the presser bar 8, the pressing device 9 can switch whether the downwardly pressing force of the presser bar 8 is transmitted to the presser foot 5, which is supported by the second member 6, by changing the position of the second member 6 relative to the first member 7. After the pressing device 9 has been mounted on the lower end portion of the presser bar 8, the pressing device 9 can set the second position of the second member 6 with consideration for the thickness of the workpiece C by adjusting the gap between the first member 7 and third member 4.

A pressing device 209 according to another variation (second variation) of the embodiment will be described with reference to FIGS. 12 and 13. The following description of the present variation simplifies or omits descriptions of structures similar to those in the embodiment illustrated in FIGS. 3 and 4 while contrasting FIG. 3 with FIG. 12 and FIG. 4 with FIG. 13. The pressing device 209 illustrated in FIG. 12 differs from the pressing device 9 illustrated in FIG. 3 primarily in the arrangement of a restricting part 267, which corresponds to the restricting part 62 in FIG. 3, and the provision of a pair of gap-adjusting members 288, which correspond to the gap-adjusting member 88 in FIG. 3.

The pressing device 209 includes a first member 270, a second member 260, a third member 240, a pair of gap-adjusting members 288, the shaft part 85, the urging member 65, and a guide part 262. The first member 270 illustrated in FIG. 13 corresponds to the first member 7 illustrated in FIG. 4. The first member 270 includes a main portion 275 which is formed with insertion holes 272 and 276 that penetrate therethrough in the up-down direction, and an insertion hole 277 that penetrates therethrough in the left-right direction. The front of the main portion 275 is configured of a mounting part 273. The mounting part 273 is formed with a circular hole 274 penetrating the main portion 275 in the left-right direction.

The second member 260 corresponds to the second member 6 illustrated in FIG. 3. The second member 260 includes a front portion 268, a step part 264, and a main portion 263. The front portion 268 is formed with a hole 261 penetrating therethrough in the left-right direction. The step part 264 is a part disposed between the front portion 268 and main portion 263 in the front-rear direction and protruding above the main portion 263. The step part 264 is formed with a recess 269 recessed downward. The recess 269 is positioned below the mounting part 273 of the first member 270.

The main portion 263 is provided to the rear of the step part 264. The guide part 262 and a restricting part 267 are fixed to the main portion 263. Each of the guide part 262 and restricting part 267 has a column-like shape that extends in the up-down direction. A contact part 266 is provided on the lower portion of the guide part 262. The contact part 266 has a ring-like shape in a plan view and protrudes upward from the top surface of the main portion 263. The restricting part 267 is positioned rearward from the recess 269 and guide part 262. The length of the restricting part 267 in the up-down direction is the same as the length of the guide part 262 in the up-down direction.

The third member 240 corresponds to the third member 4 illustrated in FIG. 3. The third member 240 includes a main portion 244 formed with insertion holes 242 and 245 that penetrate therethrough in the up-down direction. The main portion 244 includes a support base 247 having a rectangular shape in a plan view on the upper-front portion thereof. The left edge of the support base 247 is positioned on the left side of the insertion hole 242 while the right edge of the support base 247 is positioned to the right of the insertion hole 242. The area on the top surface of the support base 247 to the left-rear of the insertion hole 242 is a contact part 251 that contacts the left gap-adjusting member 288, while the area on the top surface of the support base 247 to the right-rear of the insertion hole 242 is a contact part 252 that contacts the right gap-adjusting member 288. The support base 247 is formed with protrusions 253 and 254 on the top surface thereof. The protrusion 253 protrudes upward in front of the contact part 251, and the protrusion 254 protrudes upward in front of the contact part 252. Each of the protrusions 253 and 254 has a triangular shape in a right-side view. The insertion hole 242 is formed between the protrusions 253 and 254.

With the urging member 65 placed around the guide part 262, the guide part 262 is inserted through the insertion hole 242 in the third member 240 and the insertion hole 272 in the first member 270. The bottom end of the urging member 65 contacts the contact part 266. A retaining ring 279 is mounted on the top end of the guide part 262. The restricting part 267 is inserted through the insertion hole 245 in the third member 240 and the insertion hole 276 in the first member 270. A retaining ring 278 is mounted on the top end of the restricting part 267. Thus, while the insertion hole 72 in which the restricting part 62 is inserted is formed forward of the mounting part 73 in the first member 7 in the embodiment illustrated in FIG. 3, the insertion hole 276 in which the restricting part 267 is inserted is formed rearward of the insertion hole 272 which is formed rearward of the mounting part 273 and in which the guide part 262 is inserted in the first member 270 in the second variation illustrated in FIG. 12.

The pair of gap-adjusting members 288 correspond to the gap-adjusting member 88 illustrated in FIG. 4. The gap-adjusting members 288 are cams that can rotate about the rotational shaft 87, which is supported by the first member 270, to change the gap between the first member 270 and third member 240 in multiple steps. One gap-adjusting member 288 is provided on each of the left and right sides of the main portion 275 constituting the first member 270. Each gap-adjusting member 288 is formed with an insertion hole 289 penetrating therethrough in the left-right direction, and has surface portions 291 through 298. While each gap-adjusting member 288 in the example illustrated in FIGS. 12 and 13 includes surface portions 291 through 298 for eight steps of adjustment, the surface portions of the gap-adjusting member 288 may be designed with any number of steps.

The rotational shaft 87 is inserted through the insertion hole 289 of each gap-adjusting member 288 and the insertion hole 277 of the first member 270 and is rotatably supported by the first member 270. A retaining ring (not illustrated) is mounted on the left end portion of the rotational shaft 87. The rotational shaft 87 is arranged between the restricting part 267 and guide part 262 in the front-rear direction.

Each of the surface portions 291 through 298 has a curved surface that extends parallel to the rotational center of the rotational shaft 87. The distance from the rotational center of the rotational shaft 87 increases in order of the surface portions 291 through 298. Any of the surface portions 291 through 298 may contact the corresponding contact part 251 or 252. As with the pressing device 9 of the embodiment, the user changes the gap between the first member 270 and third member 40 in multiple steps by operating the dial 86 in the pressing device 209 of the second variation.

In a plane parallel to both the longitudinal direction of the presser bar 8, i.e., the up-down direction, and the front-rear direction, a line connecting the contact point between each of the gap-adjusting member 288 and the corresponding contact part 251 or 252 and the axial center of the rotational shaft 87 inserted through the corresponding insertion hole 289 is perpendicular to the corresponding contact part 251 or 252 and parallel to the longitudinal direction of the presser bar 8. Therefore, the gap-adjusting members 288 will not rotate inadvertently when receiving a force from the presser bar spring 81. Hence, the pressing device 209 cannot change which of the surface portions 291 through 298 is in contact with the corresponding contact part 251 or 252 with merely a force against the pressing force applied in the up-down direction.

Further, as the two gap-adjusting members 288 rotate about the rotational shaft 87, changing which of the surface portions 291 through 298 contacts the corresponding contact parts 251 and 252, the protrusions 253 and 254 of the third member 240 may contact the corresponding gap-adjusting members 288. When the surface portions 291 contact the corresponding contact parts 251 and 252, for example, a wall portion 299 connecting the surface portions 291 and 298 in each gap-adjusting member 288 contacts the front surface of the corresponding protrusion 253 or 254. Each wall portion 299 is a surface portion that extends in a direction away from the rotational shaft 87. Through contact with the wall portions 299, the protrusions 253 and 254 restrict the corresponding gap-adjusting members 288 from rotating further counterclockwise in a right-side view from the state in which the surface portions 291 are in contact with the corresponding contact parts 251 and 252. Hence, the protrusions 253 and 254 define the end position for the rotation of the gap-adjusting members 288.

In another example, when the surface portions 298 contact the corresponding contact parts 251 and 252, the surface portions 298 are also in contact with the back surfaces of the corresponding protrusions 253 and 254. Therefore, when the protrusions 253 and 254 contact the gap-adjusting members 288, the pressing device 209 can better prevent changes in the surface portions 291 through 298 contacting the contact parts 251 and 252 caused merely by a force against the pressing force applied in the up-down direction.

When any of the surface portions 291 through 298 of the gap-adjusting members 288 are in contact with the corresponding contact parts 251 and 252, the protrusions 253 and 254 may be spaced apart from or in contact with the corresponding gap-adjusting members 288. The protrusions 253 and 254 may also function as regulating members that, when in contact with the gap-adjusting members 288, restrict the gap-adjusting members 288 from rotating inadvertently.

In the pressing device 209 of the second variation described above, the structure in front of the presser bar 8 is simpler than that of the pressing device 9 of the embodiment when the mounting part 273 of the first member 270 is mounted on the presser bar 8, providing higher visibility of the workpiece C and the needle 35. Thus, the ease of performing sewing operations is improved over that of the pressing device 9 of the embodiment. With the pressing device 209, there is no need to restrict the range in which components extend in the up-down direction in order to ensure the area in front of the presser bar 8 is visible, as there is with the restricting part 62 of the pressing device 9 in the embodiment. Accordingly, since the pressing device 209 enables a longer length of the restricting part 267 in the up-down direction than that of the restricting part 62 of the pressing device 9, the pressing device 209 can properly suppress forces that cause the pressing device 209 to rotate about the guide part 262. Further, since the pressing device 9 provides the restricting part 267 to the rear of the presser bar 8, interference between the threading mechanism 37 (see FIG. 2) and the restricting part 267 with respect to the needle 35 provided in front of the presser bar 8 can be avoided to ensure reliable threading of the needle 35.

In the pressing device 9 of the embodiment illustrated in FIG. 3, the gap-adjusting member 88 is provided between the left wall 701 and right wall 702 of the first member 7, but the two gap-adjusting members 288 are arranged one on either side of the first member 7 in the pressing device 209 of the second variation illustrated in FIG. 12. The pressing device 209 can prevent the gap-adjusting members 288 from rotating inadvertently and changing the gap between the first member 270 and third member 240 due to a pressing force acting on the gap-adjusting members 288 in the up-down direction.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

The structures of the sewing machine 1 and the pressing device 9, pressing device 109, or pressing device 209 may be modified as appropriate. The sewing machine 1 may be an industrial sewing machine. The member that the presser bar clamp 82 contacts while the needle bar 31 of the sewing machine 1 reciprocates in the up-down direction may be a member other than the lever 90. The presser bar clamp 82 need not contact the lever 90 or another member while the needle bar 31 of the sewing machine 1 reciprocates in the up-down direction. The fixing member that fixes the pressing device 9 to the presser bar 8 may be modified as needed. For example, a bolt and nut or the like may be used in place of the screw 41. The direction in which the sewing machine 1 conveys the workpiece C may be modified as appropriate. The sewing machine 1 need not be provided with the feed dog drop mechanism 24. The feed dog drop mechanism 24 may be configured to be driven manually.

The guide parts 67, 167, and 262 and the restricting parts 62, 179, and 267 need not be columnar shaped shafts. The guide part 67 and restricting part 62 need not both be fixed to the first member 7. The guide part 67 may have any configuration for guiding movement of the second member 6 and third member 4 relative to the first member 7. For example, the guide part 67 may be a rail-like part that is fixed to one of the first member 7, second member 6, and third member 4 functioning as a fixed member and that engages with a member other than the fixed member of the first member 7, second member 6, and third member 4.

In addition to being shaped as circular holes in a plan view that penetrate the first member 7, 170, and 270 in the up-down direction, the insertion holes 72, 76, and 276 may be formed in other shapes such as notches formed in the up-down direction. The guide part 67 may be a cylinder fixed to the second member 6, and the urging member 65 configured as a coil spring may be inserted inside the cylindrical guide part 67. The type, layout, and the like of the urging member 65 may be modified as appropriate.

With the pressing device 9 mounted on the presser bar 8, i.e., in the mounted state of the pressing device 9, the rotational shaft 87 may extend in a direction other than the left-right direction when the direction that the sewing machine 1 conveys a workpiece C is rearward. When the rotational shaft 87 extends in the left-right direction, the dial 86 may be disposed on the left end portion of the rotational shaft 87. When the rotational shaft 87 extends in the front-rear direction, the dial 86 may be disposed on the rear end portion or front end portion of the rotational shaft 87.

The structure of the gap-adjusting member 88 may be modified as needed. The dial 86 may have a radius less than or equal to the maximum radius of the gap-adjusting member 88. The gap-adjusting member 88 may be capable of rotating about the rotational shaft 87 supported by the first member 7 for changing the gap between the first member 7 and third member 4 in two steps or four steps or more. The gap-adjusting member 88 may have a curved outer circumference that can change the gap between the first member 7 and third member 4 linearly. The pressing device 9 may include another operating member in place of the dial 86, such as a lever that is coupled to an end portion of the rotational shaft 87, and the rotational shaft 87 may be configured to rotate when this operating member is operated.

The method of mounting the pressing device 9 in the embodiment may be modified as needed. The pressing device 9 may be mounted on the presser bar 8 on the condition that the top of the feed dog 19 is lower than the top surface of the throat plate 3. In this case, the user first places the workpiece C between the presser foot 5 and throat plate 3, then operates the dial 86 to place the presser foot 5 in contact with the workpiece C, and finally operates the dial 86 again to increase the gap to one step larger than the gap corresponding to the thickness of the current workpiece C. When implementing these operations, the amount of thickness variation among each of the surface portions 97 through 99 must be set smaller than the raised amount of the feed dog 19 in the sewing machine 1, for example.

In addition to the gap-adjusting member 88, the pressing device 9 of the embodiment may be provided with the gap-adjusting member 150 of the first variation. In this case, the user may adjust the gap between the first member 7 and third member 4 according to the following procedure. The user positions the bottom end of the needle 35 above the throat plate 3 by placing the needle 35 around the top of its range of movement in the up-down direction, and positions the top of the feed dog 19 above the throat plate 3 by placing the feed dog 19 around the top of its range of movement in the up-down direction. After placing a workpiece C between the presser foot 5 and throat plate 3, the user adjusts the dial 86 to place the presser foot 5 in contact with the workpiece C. Finally, the user rotates the lever 152 of the gap-adjusting member 150 clockwise in a right-side view to increase the gap between the first member 7 and third member 4.

The gap-adjusting member 88 should contact at least one of the first member 7 and third member 4. For example, a plurality of protrusions that protrude upward by different amounts of protrusion may be provided on the contact part 46 of the third member 4. With this configuration, the gap between the first member 7 and third member 4 can be changed in multiple steps by changing which protrusion is contacted by the gap-adjusting member 88 supported by the first member 7. Similarly, a plurality of protrusions that protrude downward at different amounts of protrusion may be provided on the bottom surface of the first member 7. In this case, the pressing device 9 can change the gap between the first member 7 and third member 4 in multiple steps by changing which protrusion that the gap-adjusting member 88 supported by the third member 4 contacts.

The sewing machine 1 may include a sensor that detects the thickness of the workpiece C, and a drive mechanism that rotates the rotational shaft 87 a prescribed amount through the drive force of a motor. The sewing machine 1 may automatically rotate the gap-adjusting member 88 about the rotational shaft 87 based on the detection value of the sensor. With this configuration, the sewing machine 1 can eliminate the user's burden of operating the gap-adjusting members 88, 150, and 288.

In the pressing device 209 of the second variation, the length of the restricting part 267 in the up-down direction may differ from the length of the guide part 262 in the up-down direction. The restricting part 267 may also be disposed closer in the front-rear direction to the mounting part 273 than the guide part 262 is to the mounting mart 273. The above variations may also be suitably combined provided that there are no inconsistencies.

What is claimed is:

1. A pressing device to be mounted in a sewing machine, the sewing machine including: a bed section on which a workpiece is to be placed; and a presser bar on which the pressing device is to be mounted, the presser bar extending in an up-down direction and being configured to be urged downward, the pressing device comprising:

a first member having a mounting part, the mounting part having a recessed shape and being mountable on the presser bar, the first member being movable in the up-down direction along with the presser bar in a mounted state in which the pressing device is mounted on the presser bar;

a second member to which a presser foot is attachable on a lower side of the second member, the presser foot being configured to press the workpiece placed on the bed section downward, the presser bar being configured to apply, through the second member, a pressing force to the presser foot downward in the mounted state;

a third member disposed between the first member and the second member to connect the first member and the second member in the up-down direction in the mounted state, the third member being movable in the up-down direction in the mounted state;

a gap-adjusting member configured to adjust a gap between the first member and the third member by contacting at least one of the first member and the third member;

an urging member configured to urge the second member and the third member away from each other with an urging force smaller than the pressing force of the presser bar; and a guide part configured to guide movement of the second member and the third member relative to the first member.

2. The pressing device according to claim 1, wherein the sewing machine further includes: a needle bar on which a needle is to be mounted, the needle bar being configured to reciprocally move in the up-down direction; and a presser bar clamp coupled with the presser bar, and wherein in the mounted state, when the gap-adjusting member adjusts the gap to change a position of the third member in the up-down direction, so that the presser bar clamp comes into contact with a specific member of the sewing machine during reciprocal movement of the needle bar in the up-down direction, causing the specific member to define a lower end of a moving range of the presser bar in the up-down direction, the second member moves relative to the first member between a first position and a second position in accordance with the reciprocal movement of the needle bar in the up-down direction, the pressing force of the presser bar being transmitted to the presser foot when the second member is in the first position, the pressing force of the presser bar being not transmitted to the presser foot when the second member is in the second position.

3. The pressing device according to claim 2, wherein the guide part has a shaft-like shape or a hollow cylindrical shape, the guide part being fixed to the second member, wherein the first member has a first insertion part through which the guide part is inserted to cause the first insertion part to restrict movement of the second member in a direction crossing the up-down direction, wherein the third member has a second insertion part through which the guide part is inserted to cause the second insertion part to restrict movement of the second member in a direction crossing the up-down direction, and wherein the urging member is a coil spring placed around or inserted into the guide part, the gap-adjusting member being configured to change a compressed state of the coil spring by adjusting the gap.

4. The pressing device according to claim 3, further comprising:

a restricting part fixed to the second member, the restricting part being disposed on an opposite side of the mounting part from the guide part in a direction perpendicular to the up-down direction in the mounted state, wherein the first member has a third insertion part through which the restricting part is inserted to cause the restricting part to restrict the second member from rotating about the guide part relative to the first member, and wherein the gap-adjusting member is disposed closer to the guide part than to the restricting part.

5. The pressing device according to claim 1, wherein the gap-adjusting member includes a cam configured to change the gap in multiple steps, and wherein the urging member is a spring whose compressed amount is changed according to the gap.

6. The pressing device according to claim 1, further comprising:

a rotational shaft supported by the first member, wherein the gap-adjusting member includes a cam rotatable about the rotational shaft and configured to change the gap in multiple steps.

7. The pressing device according to claim 6, further comprising:

a dial having a radius larger than a radius of the cam, wherein the rotational shaft extends in a direction perpendicular to the up-down direction in the mounted state to have an extending end portion, and wherein the dial is mounted on the extending end portion of the rotational shaft, rotation of the dial rotating the cam.

8. The pressing device according to claim 7, wherein in the mounted state, the sewing machine is configured to convey the workpiece rearward, the direction in which the rotational shaft extends being a left-right direction, the extending end portion being a right end portion of the rotational shaft.

9. A sewing machine comprising:

a sewing machine motor;

a needle bar extending in an up-down direction and having a lower end portion on which a needle is to be mounted, the needle bar being configured to be urged downward, the needle bar being configured to be driven by the sewing machine motor to move in the up-down direction;

a throat plate formed with a needle hole and an opening, the needle being configured to pass through the needle hole in accordance with movement of the needle bar in the up-down direction;

a feed dog configured to emerge from and be retracted beneath the opening, the feed dog being configured to feed a workpiece placed on the throat plate;

a feed mechanism configured to be driven by the sewing machine motor to drive the feed dog;

a presser bar extending in the up-down direction and having a lower end portion, the presser bar being configured to move in the up-down direction in synchronization with movement of the feed dog, the presser bar being configured to be urged downward; and a pressing device detachably mounted on the lower end portion of the presser bar, the pressing device comprising:

a first member having a mounting part, the mounting part having a recessed shape and being mountable on the presser bar, the first member being movable in the up-down direction along with the presser bar in a mounted state in which the first member is mounted on the presser bar;

a second member to which a presser foot is attachable on a lower side of the second member, the presser foot being configured to press the workpiece placed on the throat plate downward, the presser bar being configured to apply, through the second member, a pressing force to the presser foot downward;

a third member disposed between the first member and the second member to connect the first member and the second member in the up-down direction, the third member being movable in the up-down direction;

a gap-adjusting member configured to adjust a gap between the first member and the third member by contacting at least one of the first member and the third member;

an urging member configured to urge the second member and the third member away from each other with an urging force smaller than the pressing force of the presser bar; and a guide part configured to guide movement of the second member and the third member relative to the first member.

10. The sewing machine according to claim 9, further comprising:

a lever configured to switch a position of the presser bar in the up-down direction by being manually operated;

a presser bar spring having a lower end in the up-down direction, the presser bar spring being configured to urge the presser bar downward with an urging force; and a presser bar clamp fixed to the presser bar, the presser bar clamp being configured to define a position of the lower end of the presser bar spring, wherein when a bottom end of the needle is positioned above the throat plate, the presser bar clamp is spaced apart from the lever to cause transmission of the urging force of the presser bar spring to the second member to be engaged, and wherein when the bottom end of the needle is positioned beneath the throat plate, the presser bar clamp contacts the lever to cause the transmission of the urging force of the presser bar spring to the second member to be disengaged.

11. The sewing machine according to claim 9, further comprising:

a presser bar clamp coupled with the presser bar, wherein when the gap-adjusting member adjusts the gap to change a position of the third member in the up-down direction, so that the presser bar clamp comes into contact with a specific member of the sewing machine during reciprocal movement of the needle bar in the up-down direction, causing the specific member to define a lower end of a moving range of the presser bar in the up-down direction, the second member moves relative to the first member between a first position and a second position in accordance with the reciprocal movement of the needle bar in the up-down direction, the pressing force of the presser bar being transmitted to the presser foot when the second member is in the first position, the pressing force of the presser bar being not transmitted to the presser foot when the second member is in the second position.

12. The sewing machine according to claim 11, wherein the guide part has a shaft-like shape or a hollow cylindrical shape, the guide part being fixed to the second member, wherein the first member has a first insertion part through which the guide part is inserted to cause the first insertion part to restrict movement of the second member in a direction crossing the up-down direction, wherein the third member has a second insertion part through which the guide part is inserted to cause the second insertion part to restrict movement of the second member in a direction crossing the up-down direction, and wherein the urging member is a coil spring placed around or inserted into the guide part, the gap-adjusting member being configured to change a compressed state of the coil spring by adjusting the gap.

13. The sewing machine according to claim 12, wherein the pressing device further comprises:

a restricting part fixed to the second member, the restricting part being disposed on an opposite side of the mounting part from the guide part in a direction perpendicular to the up-down direction, wherein the first member has a third insertion part through which the restricting part is inserted to cause the restricting part to restrict the second member from rotating about the guide part relative to the first member, and wherein the gap-adjusting member is disposed closer to the guide part than to the restricting part.

14. The sewing machine according to claim 13, wherein the gap-adjusting member includes a cam configured to change the gap in multiple steps, and wherein the urging member is a spring whose compressed amount is changed according to the gap.

15. The sewing machine according to claim 9, wherein the pressing device further comprises:

a rotational shaft supported by the first member, and wherein the gap-adjusting member includes a cam rotatable about the rotational shaft and configured to change the gap in multiple steps.

16. The sewing machine according to claim 15, wherein the pressing device further comprises:

a dial having a radius larger than a radius of the cam, wherein the rotational shaft extends in a direction perpendicular to the up-down direction to have an extending end portion, and wherein the dial is mounted on the extending end portion of the rotational shaft, rotation of the dial rotating the cam.

17. The sewing machine according to claim 16, wherein the sewing machine is configured to convey the workpiece rearward, the direction in which the rotational shaft extends being a left-right direction, the extending end portion being a right end portion of the rotational shaft.

* * * * *